US008455169B2

(12) United States Patent
Inoue et al.

(10) Patent No.: US 8,455,169 B2
(45) Date of Patent: Jun. 4, 2013

(54) TONER, METHOD FOR PREPARING THE TONER, AND IMAGE FORMING METHOD USING THE TONER

(75) Inventors: Daisuke Inoue, Numazu (JP); Fumihiro Sasaki, Fuji (JP); Osamu Uchinokura, Mishima (JP); Satoshi Kojima, Numazu (JP); Hideki Sugiura, Numazu (JP); Naoko Morisawa, Ebina (JP)

(73) Assignee: Ricoh Company, Limited, Tokyo (JP)

( * ) Notice: Subject to any disclaimer, the term of this patent is extended or adjusted under 35 U.S.C. 154(b) by 409 days.

(21) Appl. No.: 12/821,546

(22) Filed: Jun. 23, 2010

(65) Prior Publication Data

US 2011/0003244 A1 Jan. 6, 2011

(30) Foreign Application Priority Data

Jul. 1, 2009 (JP) ..... 2009-157230

(51) Int. Cl.
*G03G 5/00* (2006.01)

(52) U.S. Cl.
USPC ..... 430/111.4; 430/137.14; 430/124.1; 430/109.4

(58) Field of Classification Search
USPC ..... 430/111.4, 137.14, 124.1, 109.4
See application file for complete search history.

(56) References Cited

U.S. PATENT DOCUMENTS

| | | | |
|---|---|---|---|
| 7,083,890 | B2 | 8/2006 | Emoto et al. |
| 7,157,201 | B2 | 1/2007 | Tomita et al. |
| 7,166,403 | B2 | 1/2007 | Ichikawa et al. |
| 7,169,525 | B2 | 1/2007 | Sugiura et al. |
| 7,258,959 | B2 | 8/2007 | Nakayama et al. |
| 7,288,353 | B2 | 10/2007 | Sugiura et al. |
| 7,318,989 | B2 | 1/2008 | Kotsugai et al. |
| 7,368,212 | B2 | 5/2008 | Sugiura et al. |
| 7,405,000 | B2 | 7/2008 | Takikawa et al. |
| 7,413,838 | B2 | 8/2008 | Sugiura et al. |
| 7,429,442 | B2 | 9/2008 | Honda et al. |
| 7,442,484 | B2 | 10/2008 | Uchinokura et al. |
| 7,452,645 | B2 | 11/2008 | Sugiura |
| 7,455,942 | B2 | 11/2008 | Nagatomo et al. |
| 7,473,508 | B2 | 1/2009 | Higuchi et al. |
| 7,531,281 | B2 | 5/2009 | Tomita et al. |
| 7,566,521 | B2 | 7/2009 | Kotsugai et al. |
| 7,608,377 | B2 | 10/2009 | Nakayama et al. |
| 7,611,815 | B2 | 11/2009 | Sugiura et al. |
| 7,664,439 | B2 | 2/2010 | Sugiura |
| 7,695,878 | B2 | 4/2010 | Seshita et al. |
| 7,727,700 | B2 | 6/2010 | Sugiura |
| 7,736,826 | B2 | 6/2010 | Higuchi et al. |
| 7,741,002 | B2 | 6/2010 | Uchinokura et al. |
| 2004/0072091 | A1 | 4/2004 | Mochizuki et al. |

(Continued)

FOREIGN PATENT DOCUMENTS

| | | |
|---|---|---|
| JP | 4375742 | 9/2009 |

*Primary Examiner* — Mark A Chapman
(74) *Attorney, Agent, or Firm* — Oblon, Spivak, McClelland, Maier & Neustadt, L.L.P.

(57) ABSTRACT

The toner includes a binder resin; a colorant; and a release agent. The first inter-particle force Fp(A) of the toner, which is measured under an environmental condition of 23° C. and 60% RH after the toner is pressed for 1 minute at 25° C. under a compression stress of 15 kg/cm$^2$, is from $1.0\times10^{-9}$ (N) to $1.0\times10^{-6}$ (N). The difference (Fp(B)−Fp(A)) between the second inter-particle force Fp(B) of the toner, which is measured under the environmental condition of 23° C. and 60% RH after the toner is pressed for 1 minute at 50° C. under a compression stress of 15 kg/cm$^2$, and the first inter-particle force Fp(A) is 0 (N) to $1.0\times10^{-7}$ (N).

17 Claims, 4 Drawing Sheets

U.S. PATENT DOCUMENTS

2005/0112488 A1 5/2005 Yamada et al.
2006/0024604 A1 2/2006 Sugiura et al.
2007/0218380 A1 9/2007 Uchinokura et al.
2007/0218381 A1 9/2007 Uchinokura et al.
2007/0218385 A1 9/2007 Kojima et al.
2008/0069616 A1 3/2008 Kojima et al.
2008/0070144 A1 3/2008 Nagatomo et al.
2008/0213682 A1 9/2008 Saitoh et al.
2008/0227015 A1 9/2008 Nagatomo et al.
2008/0227018 A1 9/2008 Awamura et al.
2008/0233498 A1 9/2008 Yamada et al.
2008/0233505 A1 9/2008 Nagatomo et al.
2008/0305423 A1 12/2008 Sugiura et al.
2009/0061345 A1 3/2009 Yamada et al.
2009/0067876 A1 3/2009 Seshita et al.
2009/0142094 A1 6/2009 Sawada et al.
2009/0142682 A1 6/2009 Saitoh et al.
2009/0142685 A1 6/2009 Nagatomo et al.
2009/0142686 A1 6/2009 Kojima et al.
2009/0142690 A1 6/2009 Awamura et al.
2009/0155709 A1 6/2009 Watanabe et al.
2009/0196658 A1 8/2009 Sugiura
2009/0269692 A1 10/2009 Awamura et al.
2009/0280421 A1 11/2009 Awamura et al.
2010/0075243 A1 3/2010 Shimota et al.

TONER, METHOD FOR PREPARING THE TONER, AND IMAGE FORMING METHOD USING THE TONER

BACKGROUND OF THE INVENTION

1. Field of the Invention

The present invention relates to a toner for use in developing an electrostatic latent image. In addition, the present invention relates to a method for preparing the toner. Further, the present invention relates to an image forming method for forming a visual image using the toner.

2. Discussion of the Background

Recently, toner (hereinafter referred to as oil-less toner) in which a wax is dispersed to impart good releasability to the toner has been used for electrophotographic image forming apparatus using an oil-less fixing device which fix toner images without applying an oil to a fixing member.

On the other hand, in order to prepare a small-sized high speed image forming apparatus, it is necessary to miniaturize the toner feeding passage thereof, which feeds toner to the developing device of the image forming apparatus. Particularly, it is necessary for full color image forming apparatus to have four toner feeding passages and four developing devices. Therefore, such full color image forming apparatus typically have small-sized and complex toner feeding passages. In this case, color toners are pressed in the feeding passages, and thereby the color toners are agglomerated, resulting in deterioration of image qualities (such as formation of spot images (such as black spot images) in a solid image).

In addition, a one-sheet copying or printing operation is frequently performed in copiers having a printer function. Even in such a one-sheet copying or printing operation, the developer (toner) is agitated every copying or printing operation, resulting in increase of the time, during which pressure (stress) is applied to the toner. In this regard, problems in that the external additives of the toner is released therefrom, and/or embedded into the toner particles, resulting in agglomeration of the toner particles, thereby deteriorating the image qualities are caused.

A published unexamined Japanese patent application No. (hereinafter referred to as JP-A) 2006-201706 discloses a toner for developing an electrostatic latent image, which has an inter-particle force of from $1.0\times10^{-9}$ to $1.0\times10^{-6}$ N, a compression adhesiveness of from 20 to 100 gf and a compression bulk density of from 300 to 800 kg/m$^3$, when the properties are measured by pressing the toner for 1 minute at 25° C. under a compression stress of 15 kg/cm$^2$.

However, when this toner is an oil-less toner (i.e., a toner in which a wax is dispersed), the wax tends to exude from toner particles and the exuded wax is present on the surface thereof if the temperature of the toner feeding passage or the developing device significantly increases, resulting in agglomeration of the toner particles, thereby deteriorating image qualities.

Because of these reasons, the inventors recognized that there is a need for a toner which can produce high quality images without causing the above-mentioned problems.

SUMMARY OF THE INVENTION

As an aspect of the present invention, a toner is provided. The toner includes a binder resin, a colorant and a release agent. The toner satisfies the following relationships (1) and (2):

$$1.0\times10^{-9}(N)\leqq Fp(A)\leqq1.0\times10^{-6}(N) \quad (1)$$

$$0(N)\leqq Fp(B)-Fp(A)\leqq1.0\times10^{-7}(N) \quad (2)$$

wherein Fp(A) represents a first inter-particle force of the toner, which is measured under an environmental condition of 23° C. and 60% RH after the toner is pressed for 1 minute at 25° C. under a compression stress of 15 kg/cm$^2$, and Fp(B) represents a second inter-particle force of the toner, which is measured under the environmental condition of 23° C. and 60% RH after the toner is pressed for 1 minute at 50° C. under a compression stress of 15 kg/cm$^2$.

As another aspect of the present invention, a method for preparing the toner mentioned above is provided. The method includes:

dissolving or dispersing toner constituents including at least a polyester resin serving as the binder resin, the colorant and the release agent in an organic solvent to prepare a first liquid;

mixing an anionic surfactant, and a particulate anionic resin, which has a volume average particle diameter of from 5 nm to 50 nm, with an aqueous medium to prepare an aqueous liquid;

emulsifying the first liquid in the aqueous liquid to prepare a second liquid;

adding a particulate resin having a volume average particle diameter of from 50 nm to 500 nm to the aqueous liquid or the second liquid; and then removing the organic solvent from the second liquid.

As yet another aspect of the present invention, an image forming method is provided. The image forming method includes:

forming an electrostatic latent image on an image bearing member;

developing the electrostatic latent image with a developer including the toner mentioned above to prepare a toner image on the image bearing member;

transferring the toner image onto a receiving material; and fixing the toner image to the receiving material.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
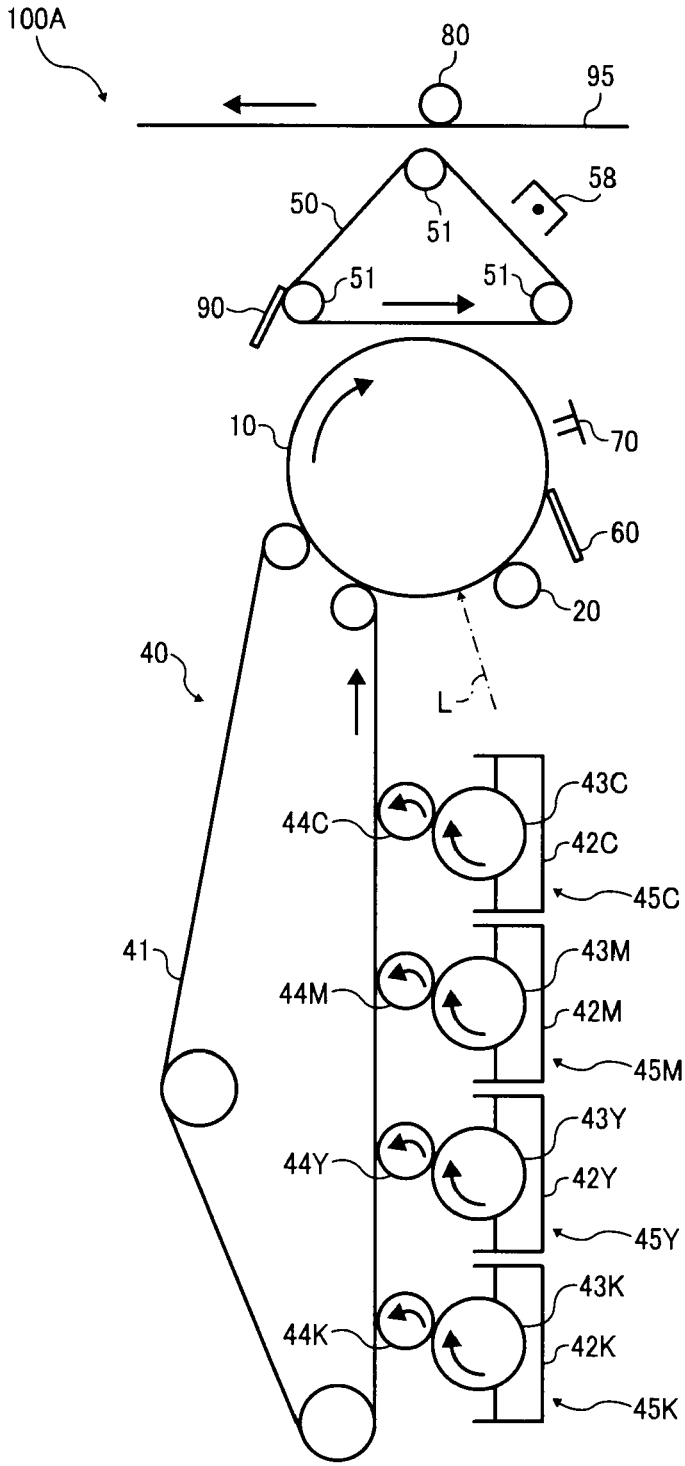
FIG. 1 is a schematic view illustrating an image forming apparatus for use in the image forming method of the present invention.

The present invention will be explained by reference to drawings.

The toner of the present invention includes a binder resin, a colorant and a release agent, and satisfies the following relationships (1) and (2):

$$1.0\times10^{-9}(N)\leqq Fp(A)\leqq1.0\times10^{-6}(N) \quad (1)$$

$$0(N)\leqq Fp(B)-Fp(A)\leqq1.0\times10^{-7}(N) \quad (2)$$

wherein Fp(A) represents the inter-particle force (hereinafter referred to as a first inter-particle force) of the toner, which is measured under an environmental condition of 23° C. and 60% RH after the toner is pressed for 1 minute at 25° C. under a compression stress of 15 kg/cm$^2$, and Fp(B) represents the inter-particle force (hereinafter referred to as a second inter-particle force) of the toner which is measured under the environmental condition of 23° C. and 60% RH after the toner is pressed for 1 minute at 50° C. under a compression stress of 15 kg/cm$^2$.

Since the toner satisfies the relationships (1) and (2), high quality images can be produced without causing the above-mentioned image quality deterioration problems.

When the first inter-particle force Fp(A) is lower than $1.0\times10^{-9}$ (N), the cohesive force of toner particles at 25° C. tends to seriously decrease. In this case, problems in that toner scattering occurs in the toner image transferring process and/or the image transferring rate in the in the toner image transferring process seriously decreases are caused. In contrast, when the first inter-particle force Fp(A) is higher than $1.0\times10^{-6}$ (N), the cohesive force of toner particles at 25° C. tends to seriously increase. In this case, problems in that the toner cannot be easily fed, and the charge stability of the toner deteriorates are caused.

When the difference (Fp(B)−Fp(A)) between the second inter-particle force Fp(B) and the first inter-particle force Fp(A) is greater than $1.0\times10^{-7}$ (N), the cohesive force of toner particles at 50° C. seriously increases. Therefore, the release agent included in the toner particles easily softens and exudes therefrom when the temperature of the developing device increases. In this case, problems in that the toner cannot be easily fed, and the charge stability of the toner deteriorates are caused.

The difference (Fp(B)−Fp(A)) is from 0 (N) to $1.0\times10^{-7}$ (N), preferably from 0 (N) to $1.0\times10^{-8}$ (N), and more preferably 0 (N).

The inter-particle force of toner can be measured using a compressive strength/tensile strength measuring instrument AGGROBOT AGR-2 from Hosokawa Micron Corporation. The procedure for measuring the inter-particle force of toner is as follows.

(1) eight (8) grams of a toner is contained in a cylindrical cell having an inside diameter of 25 mm, which can be separated into upper and lower parts;

(2) the toner is compressed for 1 minute under a compression stress of 15 kg/cm$^2$ while controlling the temperature of the container is at 25° C. (or 50° C.); and (3) after the container is allowed to settle under environmental conditions of 23° C. and 60% RH, the upper part of the container is pulled up to determine the tensile strength of the toner layer at 25° C. (or 50° C.) (i.e., the tensile force at which the toner layer is broken).

In this regard, the wire of the spring has a diameter of 1.0 mm, and the compressing speed and the pulling speed are 0.1 mm/sec and 0.2 mm/sec, respectively.

The binder resin of the toner is not particularly limited, and any known resins can be used. Specific examples thereof include polyester resins, silicone resins, styrene-acrylic resins, styrene resins, acrylic resins, epoxy resins, diene resins, phenolic resins, terpene resins, coumarone resins, amide-imide resins, butyral resins, urethane resins, ethylene-vinyl acetate resins, etc. These resins can be used alone or in combination.

Among these resins, polyester resins are preferably used. This is because polyester resins have a sharp melt property, and thereby good smoothness can be imparted to the surface of a fixed toner image. It is more preferable to use a combination of a urea-modified polyester resin, which can further include a urethane bond, and an unmodified polyester resin as the binder resin of the toner. The molar ratio (UT/UR) of the urethane bond (UT) to the urea bond (UR) is generally from 0 to 9, preferably from 0.25 to 0.4, and more preferably from 2/3 to 7/3. When the molar ratio is greater than 9, the offset resistance of the toner tends to deteriorate.

Unmodified polyester resins can be prepared by subjecting a polyol having a formula, A(OH)m, and a polycarboxylic acid having a formula, B(COOH)n, to a polycondensation reaction. In the formulae, A represents a fatty acid group, an aromatic group or a heteroaromatic group, which has 1 to 20 carbon atoms and which can have a substituent; m is an integer of from 2 to 4; B represents a fatty acid group, an aromatic group or a heteroaromatic group, which has 1 to 20 carbon atoms and which can have a substituent; and n is an integer of from 2 to 4.

The polyol is not particularly limited, and any known polyols can be used. Specific examples thereof include ethylene glycol, diethylene glycol, triethylene glycol, 1,2-propylene glycol, 1,3-propylene glycol, 1,4-butane diol, neopentyl glycol, 1,4-butene diol, 1,5-pentane diol, 1,6-hexane diol, 1,4-cyclohexane dimethanol, dipropylene glycol, polyethylene glycol, polypropylene glycol, polytetramethylene glycol, sorbitol, 1,2,3,6-hexene tetrol, 1,4-sorbitane, pentaerythritol, dipentaerythritol, tripentaerythritol, 1,2,4-butane triol, 1,2,5-pentane triol, glycerol, 2-methylpropane triol, 2-methyl-1,2,4-butane triol, trimethylol ethane, trimethylol propane, 1,3,5-trihydroxymethyl benzene, bisphenol A, ethylene oxide adducts of bisphenol A, propylene oxide adducts of bisphenol A, hydrogenated bisphenol A, ethylene oxide adducts of hydrogenated bisphenol A, propylene oxide adducts of hydrogenated bisphenol A, etc. These polyols can be used alone or in combination.

Any known carboxylic acids can be used as the polycarboxylic acid. Specific examples thereof include maleic acid, fumaric acid, citraconic acid, itaconic acid, glutaconic acid, fumaric acid, isophthalic acid, terephthalic acid, succinic acid, adipic acid, sebacic acid, azelaic acid, moronic acid, n-dodecenylsuccinic acid, isooctylsuccinic acid, isododecenylsuccinic acid, n-dodecylsuccinic acid, isododecylsuccinic acid, n-octenylsuccinic acid, n-octylsuccinic acid, isooctenylsuccinic acid, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylc acid, 1,3-dicarboxyl-2-methyl-2-methylenecarboxypropane, 1,2,4-cyclohexanetriacarboxylic acid, tetra(methylenecarboxyl)methane, 1,2,7,8-octanetetracarboxylic acid, pyromellitic acid, trimer acids of embole, cyclohexanedicarboxylic acid, cyclohexenedicarboxylic acid, butanetetracarboxylic acid, diphenylsulfonetetracarboxylic acid, ethyleneglycolbis(trimellitic acid), etc. These polycarboxylic acids can be used alone or in combination.

Specific examples of the binder resin include:

(1) mixtures of a product prepared by subjecting an ethylene oxide (2 mole) adduct of bisphenol A and isophthalic acid to a polycondensation reaction, and a urea-modified polyester prepared by reacting isophorone diamine with a prepolymer, which has been prepared by reacting isophorone diisocyanate with a polycondensation product of an ethylene oxide (2 mole) adduct of bisphenol A and isophthalic acid;

(2) mixtures of a product prepared by subjecting an ethylene oxide (2 mole) adduct of bisphenol A and terephthalic acid to a polycondensation reaction, and a urea-modified polyester prepared by reacting isophorone diamine with a prepolymer, which has been prepared by reacting isophorone diisocyanate with a polycondensation product of an ethylene oxide (2 mole) adduct of bisphenol A and isophthalic acid;

(3) mixtures of a product prepared by subjecting an ethylene oxide (2 mole) adduct of bisphenol A, a propylene oxide (2 mole) adduct of bisphenol A, and terephthalic acid to a polycondensation reaction, and a urea-modified polyester prepared by reacting isophorone diamine with a prepolymer, which has been prepared by reacting isophorone diisocyanate with a polycondensation product of an ethylene oxide (2 mole) adduct of bisphenol A, a propylene oxide (2 mole) adduct of bisphenol A, and terephthalic acid;

(4) mixtures of a product prepared by subjecting a propylene oxide (2 mole) adduct of bisphenol A, and terephthalic acid to a polycondensation reaction, and a urea-modified polyester prepared by reacting isophorone diamine with a prepolymer, which has been prepared by reacting isophorone diisocyanate with a polycondensation product of an ethylene oxide (2 mole) adduct of bisphenol A, a propylene oxide (2 mole) adduct of bisphenol A, and terephthalic acid;

(5) mixtures of a product prepared by subjecting an ethylene oxide (2 mole) adduct of bisphenol A, and terephthalic acid to a polycondensation reaction, and a urea-modified polyester prepared by reacting hexamethylene diamine with a prepolymer, which has been prepared by reacting isophoronediisocyanate with a polycondensation product of an ethylene oxide (2 mole) adduct of bisphenol A, and terephthalic acid;

(6) mixtures of a product prepared by subjecting an ethylene oxide (2 mole) adduct of bisphenol A, a propylene oxide (2 mole) adduct of bisphenol A, and terephthalic acid to a polycondensation reaction, and a urea-modified polyester prepared by reacting hexamethylene diamine with a prepolymer, which has been prepared by reacting isophorone diisocyanate with a polycondensation product of an ethylene oxide (2 mole) adduct of bisphenol A, and terephthalic acid;

(7) mixtures of a product prepared by subjecting an ethylene oxide (2 mole) adduct of bisphenol A, and terephthalic acid to a polycondensation reaction, and a urea-modified polyester prepared by reacting ethylene diamine with a prepolymer, which has been prepared by reacting isophorone diisocyanate with a polycondensation product of an ethylene oxide (2 mole) adduct of bisphenol A, and terephthalic acid;

(8) mixtures of a product prepared by subjecting an ethylene oxide (2 mole) adduct of bisphenol A, and isophthalic acid to a polycondensation reaction, and a urea-modified polyester prepared by reacting hexamethylene diamine with a prepolymer, which has been prepared by reacting diphenylmethane diisocyanate with a polycondensation product of an ethylene oxide (2 mole) adduct of bisphenol A, and isophthalic acid;

(9) mixtures of a product prepared by subjecting an ethylene oxide (2 mole) adduct of bisphenol A, a propylene oxide (2 mole) adduct of bisphenol A, and terephthalic acid to a polycondensation reaction, and a urea-modified polyester prepared by reacting hexamethylene diamine with a prepolymer, which has been prepared by reacting diphenylmethane diisocyanate with a polycondensation product of an ethylene oxide (2 mole) adduct of bisphenol A, a propylene oxide (2 mole) adduct of bisphenol A, terephthalic acid, and dodecenylsuccinic anhydride; and

(10) mixtures of a product prepared by subjecting an ethylene oxide (2 mole) adduct of bisphenol A, and isophthalic acid to a polycondensation reaction, and a urea-modified polyester prepared by reacting hexamethylene diamine with a prepolymer, which has been prepared by reacting tolylene diisocyanate with a polycondensation product of an ethylene oxide (2 mole) adduct of bisphenol A, and isophthalic acid;

The weight average molecular weight of the binder resin included in the toner of the present invention is generally not lower than $3\times10^3$, preferably from $5\times10^3$ to $1\times10^6$, and more preferably from $7\times10^3$ to $5\times10^5$. When the weight average molecular weight is lower than $3\times10^3$, the offset resistance of the toner tends to deteriorate.

In this application, the number average molecular weight and the weight average molecular weight are polystyrene-equivalent molecular weights determined by gel permeation chromatography (GPC).

The glass transition temperature of the binder resin is preferably from 30 to 70° C., and more preferably from 40 to 65° C. When the glass transition temperature of the binder resin is lower than 30° C., the high temperature preservability of the toner tends to deteriorate. In contrast, when the glass transition temperature of the binder resin is higher than 70° C., the low temperature fixability of the toner tends to deteriorate.

In this application, the glass transition temperature is determined using a TG-DSC system, TAS-100 from Rigaku Corporation.

The colorant included in the toner is not particularly limited, and any known pigments and dyes can be used therefor. Specific examples thereof include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

Master batches, which are complexes of a colorant with a resin (binder resin), can be used as the colorant of the toner of the present invention.

Such master batches can be prepared by mixing a resin and a colorant, and kneading the mixture while applying a high shearing force thereto. In this case, an organic solvent can be added to enhance the interaction between the colorant and the resin. In addition, a flushing method, in which an aqueous paste including a colorant and water is mixed with a resin dissolved in an organic solvent, the mixture is kneaded to transfer the colorant from the aqueous phase to the resin side (i.e., the oil phase), and then the organic solvent (and water, if desired) is removed from the kneaded mixture, can be preferably used because the resultant wet cake can be used without being dried. When performing the mixing and kneading process, dispersing devices capable of applying a high shearing force such as three roll mills can be preferably used.

Specific examples of the resins for use in the master batches include styrene polymers and substituted styrene polymers such as polystyrene, poly-p-chlorostyrene and polyvinyl toluene; copolymers of styrene (and substituted styrene) such styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleate copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic acid resins, rosin, modified rosins, terpene resins, aliphatic or alicyclic hydrocarbon resins, aromatic petroleum resins, chlorinated paraffin, paraffin waxes, etc. These resins are used alone or in combination.

The content of a colorant in the toner is preferably from 1 to 15% by weight, and more preferably from 3 to 10% by weight of the toner. When the content is lower than 1% by weight, the toner is not sufficiently colored. In contrast, when the content is higher than 15%, the colorant cannot be well dispersed in the binder resin, resulting in occurrence of problems in that the toner is not sufficiently colored and the resultant toner has poor electric properties.

The release agent to be included in the toner of the present invention is not particularly limited, and any known materials used as release agents can be used as the release agent. Specific examples thereof include natural waxes such as vegetable waxes (e.g., carnauba waxes, cotton waxes, Japan waxes, and rice waxes), animal waxes (e.g., bees waxes, and lanolin), mineral waxes (e.g., ozocerite and ceresin waxes), and petroleum waxes (e.g., paraffin waxes, microcrystalline waxes and petrolatum); synthesized release agents such as synthesized hydrocarbon waxes (e.g., polyethylene waxes), esters, ketones and ethers, fatty acid amides (e.g., 12-hydroxystearamide, and stearamide), and crystallized polymers having a long alkyl group in a side chain thereof (e.g., n-stearyl polymethacrylate, n-lauryl polymethacrylate, and n-stearyl methacrylate-ethyl methacrylate copolymers). These release agents can be used alone or in combination.

The release agent included in the toner of the present invention preferably has a melting point of from 50 to 120° C., and more preferably from 60 to 90° C. When the melting point is lower than 50° C., the high temperature preservability of the toner tends to deteriorate. In contrast, when the melting point is higher than 120° C., the offset resistance and low temperature fixability of the toner tends to deteriorate.

The release agent preferably has a melt viscosity of from 5 to 1,000 mP·s (cps), and more preferably from 10 to 100 mP·s (cps) at a temperature 20° C. higher than the melting point thereof. When the melt viscosity of the release agent is lower than 5 mP·s, it is hard to impart good releasability to the toner. In contrast, when the melt viscosity is higher than 1,000 mP·s, it is hard to impart a good combination of offset resistance and low temperature fixability to the toner.

The content of a release agent in the toner is preferably from 0 to 40% by weight, and more preferably from 3 to 30% by weight. When the content is higher than 40% by weight, the fluidity of the toner tends to deteriorate.

The toner of the present invention preferably includes a modified layered inorganic material (i.e., intercalation compound), in which at least part of the metal cations included therein is exchanged with an organic cation. Using such a modified layered inorganic material makes it possible to prepare a deformed toner.

Such modified layered inorganic materials mean layered inorganic materials in which part of metal cations present between overlaid layers each having a thickness of about few micrometers and constituting the inorganic material is substituted with an organic cation, and have been disclosed in published PCT applications No. 2003-515795, 2006-500605 and 2006-503313.

Specific examples of such layered inorganic materials include montmorillonite, bentonite, hectorite, attapulgite, sepiolite, etc. These materials can be used alone or in combination. Among these materials, montmorillonite and bentonite are preferably used because of being capable of controlling the melt viscosity of the toner even when the material is added in such a small amount as not to influence the other properties of the toner.

The organic cations for use in substituting metal cations are not particularly limited. Specific examples of such organic cations include quaternary ammonium ions such as trimethylstearyl ammonium ions, dimethylstearylbenzyl ammonium ions; phosphonium ions, imidazolium ions, etc. Among these ions, quaternary ammonium ions can be preferably used.

By substituting divalent metal cations, which are present between overlaid layers of a layered inorganic material, with a trivalent metal cation, organic anions can be incorporated into the layered inorganic material. Such organic anions are not particularly limited. Specific examples thereof include sulfate ions, sulfonate ions, carboxylate ions and phosphate ions, which have a group such as linear, branched or cyclic alkyl groups having one to 44 carbon atoms, alkenyl groups having one to 22 carbon atoms, alkoxyl groups having 8 to 32 carbon atoms, hydroxyalkyl groups having 2 to 22 carbon atoms, ethylene oxide groups, and/or propylene oxide groups. Among these anions, carboxylate ions having an ethylene oxide skeleton are preferably used.

Specific examples of the marketed products of organic-cation-modified layered inorganic materials include quaternium-18 bentonite such as BENTONE 3, BENTONE 38, BENTONE 38V, (from Elementis Specialties), THIXOGEl VP (from United Catalyst), CLAYTON 34, CLAYTON 40, and CLAYTON XL (from Southern Clay); stearalkonium bentonite such as BENTONE 27 (from Elementis Specialties), THIXOGEl LG (from United Catalyst), CLAYTON AF and CLAYTON APA (from Southern Clay); quaternium-18/benzalkonium bentonite such as CLAYTON HT and CLAYTON PS (from Southern Clay), etc. Among these materials, CLAYTON AF and CLAYTON APA are preferably used.

Specific examples of the organic-anion-modified layered inorganic materials include DHT-4A (from Kyowa Chemical Industry Co., Ltd.) which includes hydrotalcite as a main component and which is modified with an organic anion having the following formula (1).

$$R1(OR2)_nOSO_3^- \quad (1)$$

wherein R1 represents an alkyl group having 13 carbon atoms; R2 represents an alkylene group having 2 to 6 carbon atoms; and n is an integer of from 2 to 10.

Specific examples of the marketed products of the compound having such an organic anion include HITENOL 330T from Dai-ichi Kogyo Seiyaku Co., Ltd.

The content of such a modified layered inorganic material in the toner is preferably from 0.05 to 2% by weight. When the content is lower than 0.05% by weight, the resultant toner tends to have a wide particle diameter distribution. In contrast, when the content is higher than 2% by weight, deformed toner particles cannot be prepared, and in addition the resultant toner tends to have a wide particle diameter distribution.

The toner of the present invention can further include other materials such as charge controlling agents, cleanability improving agents and particulate inorganic materials.

Any known charge controlling agents can be used for the toner.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, copper phthalocyanine, perylene, quinacridone, azo pigments, polymer compounds having a functional group such as sulfonate groups, carboxylate groups, and quaternary ammonium groups, etc. These materials can be used alone or in combination.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.

The content of a charge controlling agent in the toner is generally from 0 to 10% by weight, and preferably from 0.2 to 5% by weight, based on the weight of the binder resin included in the toner. When the content is higher than 10% by weight, the charge quantity of the toner tends to seriously increase, resulting in occurrence of problems in that the fluidity of the toner deteriorates and the image density of toner images decreases.

The cleanability improving agent is not particularly limited, and any known cleanability improving agents can be used for the toner of the present invention. Specific examples thereof include fatty acid metal salts such as zinc stearate, calcium stearate, and stearic acid; particulate resins, which are prepared by a soap-free emulsion polymerization method and which preferably have a volume average particle diameter of from 0.01 to 1 μm, such as particulate polymethyl methacrylate, and particulate polystyrene; etc. These materials can be used alone or in combination.

The particulate inorganic material to be included in the toner is not particularly limited, and any known particulate inorganic materials can be used. Specific examples thereof include silica, alumina, titanium oxide, barium titanate, magnesium titanate, calcium titanate, strontium titanate, zinc oxide, tin oxide, quartz sand, clay, mica, wollastonite, diatom earth, chromium oxide, cerium oxide, red iron oxide, antimony trioxide, magnesium oxide, ziroconium oxide, barium oxide, barium carbonate, calcium carbonate, silicon carbide, silicon nitride, etc. These particulate inorganic materials can be used alone or in combination.

It is preferable for the toner to include a particulate inorganic material (hereinafter referred to as particulate inorganic material A) having a BET specific surface area of from 50 to 400 $m^2/g$. The particulate inorganic material A preferably has an average primary particle diameter of from 5 to 50 nm, and more preferably from 10 to 30 nm.

It is also preferable for the toner to include a combination of such a particulate inorganic material A and a particulate inorganic material B, which has a BET specific surface area of from 20 to 35 $m^2/g$ and which has an average primary particle diameter of from 50 to 500 nm, more preferably from 100 to 400 nm, and even more preferably from 120 to 360 nm.

It is preferable that the surface of such particulate inorganic materials is subjected to a treatment using an agent such as silane coupling agents, silylating agents, silane coupling agents having a fluorinated alkyl group, organic titanate coupling agents, aluminum coupling agents, silicone oils, and modified silicone oils. By including such a treated inorganic material in the toner, the fluidity and charge properties of the toner are hardly deteriorated even under high humidity conditions.

The content of each of the particulate inorganic materials A and B is from 0 to 5% by weight, and preferably from 0.01 to 2.0% by weight.

The toner of the present invention preferably has an average circularity of from 0.94 to 0.99. When the average circularity is lower than 0.94, the transferring property of the toner tends to deteriorate. In contrast, when the average circularity is higher than 0.99, the cleaning property of the toner tends to deteriorate.

In the present application, the average circularity of the toner is measured with a flow-type particle analyzer FPIA-2100 from Sysmex Corporation.

The toner of the present invention preferably has a volume average particle diameter of from 3 to 8 μm. When the volume average particle diameter is less than 3 μm, a problem in that the toner fixedly adheres to the surface of a carrier when the toner and carrier (i.e., two component developer) are agitated for a long period of time in a developing device, resulting in deterioration of the charging ability of the carrier tends to occur. In addition, when the toner is used as a one component developer, problems in that the toner adheres to a developing roller and/or a blade used for forming a toner layer on the developing roller, resulting in formation of a toner film thereon tend to occur. In contrast, when the volume average particle diameter is greater than 8 μm, problems in that image qualities (such as resolution) deteriorate; and the particle diameter distribution seriously changes when the developer (two component developer) is used while a supplementary toner is supplied to the developer, resulting in variation of image qualities tend to occur.

It is preferable for the toner of the present invention that the ratio Dv/Dn of the volume average particle diameter (Dv) to the number average particle diameter (Dn) is from 1.00 to 1.30. When the ratio is greater than 1.30, a problem in that the behavior of the toner in the developing process varies, and thereby the reproducibility of small dot images is deteriorated (i.e., high quality images cannot be produced) tends to occur.

In the present application, the volume average particle diameter and number average particle diameter are measured with a particle diameter measuring instrument, MULTISIZER III from Beckman Coulter Inc.

It is preferable for the toner of the present invention to include particles having particle diameters of not greater than 2 μm in an amount of from 1 to 10% by number. When the amount of particles having particle diameters of not greater than 2 μm is larger than 10% by number, a problem in that when the developer (i.e., two component developer) is agitated for a long period of time in a developing device, the toner adheres to the surface of the carrier, resulting in deterioration of the charging ability of the carrier tends to occur.

In the present application, the content of particles having particle diameters of not greater than 2 μm in the toner is measured with a flow-type particle analyzer, FPIA-2100 from Sysmex Corp.

Next, the method for preparing the toner of the present invention will be explained.

The toner preparation method includes:

(1) an aqueous medium preparation process of adding an anionic surfactant and an anionic particulate resin (hereinafter referred to as particulate resin A) having a volume average particle diameter of from 5 to 50 nm to an aqueous medium to prepare an aqueous medium;

(2) a first liquid preparation process of dissolving or dispersing toner constituents including a polyester resin in an organic solvent to prepare a first liquid;

(3) a second liquid preparation process of emulsifying the first liquid in the aqueous medium to prepare a second liquid; and (4) an organic solvent removing process of removing the organic solvent from the second liquid.

In addition, the method includes a process of adding a particulate resin (hereinafter referred to as particulate resin B) having a volume average particle diameter of from 50 to 500 nm so that the second liquid includes the particulate resin B before the organic solvent removing process. Specifically, the particulate resin B is added to the aqueous medium before the first liquid is added to the aqueous medium. Alternatively, the particulate resin B may be added to the aqueous medium while the first liquid is added to the aqueous medium to be emulsified in the aqueous medium. Alternatively, the particulate resin B may be added to the second liquid before removing the organic solvent from the second liquid.

By using this method, mother toner particles (i.e., particles of the toner constituents) having a surface to which the particulate resins A and B adhere can be prepared. Specifically, the particulate resin A mainly adheres to the body of the mother toner particles and the particulate resin B mainly adheres to the mother toner particles with the particulate resin A therebetween. Namely, the particulate resin B is mainly present on the outermost surface of the particulate resin A.

Since the particulate resin B adheres to the surface of the mother toner particles (with the particulate resin A therebetween), the toner of the present invention satisfies relationship (1) mentioned above. In addition, since the particulate resin A adheres to the body of the mother toner particles, the toner satisfies relationship (2) mentioned above and occurrence of a problem in that the particulate resin B is embedded into the body of the mother toner particles is prevented.

When the volume average particle diameter of the particulate resin A is smaller than 5 nm, the effect of preventing the particulate resin B from being embedded into the body of the mother toner particles is hardly produced. In contrast, when the volume average particle diameter of the particulate resin A is larger than 50 nm, the effect of preventing the release agent from exuding from the mother toner particles is hardly produced.

When the volume average particle diameter of the particulate resin B is smaller than 50 nm, the resultant toner does not satisfy relationship (1). In contrast, when the volume average particle diameter of the particulate resin B is larger than 500 nm, the particulate resin B tends to be released from the mother toner particles.

The material for use as the aqueous medium is not particularly limited, and water and any known solvents which can be mixed with water can be used as the aqueous medium.

Specific examples thereof include water, alcohol solvents such as methanol, isopropanol, and ethylene glycol; dimethylformamide; tetrahydrofuran; cellosolves such as methyl cellosolve; lower ketones such as acetone and methyl ethyl ketone; etc.

The anionic surfactant for use in preparing the aqueous medium is not particularly limited, and any known anionic surfactants can be used. Among such anionic surfactants, alkylbenzene sulfonates, α-olefin sulfonates, and phosphates are preferably used. Anionic surfactants having a fluoroalkyl group are more preferably used.

Specific examples of such anionic surfactants having a fluoroalkyl group include fluoroalkyl carboxylic acids having from 2 to 10 carbon atoms and their metal salts, disodium perfluorooctanesulfonylglutamate, sodium 3-{ω-fluoroalkyl (C6-C11)oxy}-1-alkyl(C3-C4) sulfonate, sodium 3-{ω-fluoroalkanoyl(C6-C8)-N-ethylamino}-1-propanesulfonate, fluoroalkyl(C11-C20) carboxylic acids and their metal salts, perfluoroalkyl carboxylic acids (C7-C13) and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyl trimethyl ammonium salts, salts of perfluoroalkyl (C6-C10)-N-ethylsulfonyl glycin, monoperfluoroalkyl(C6-C16)ethylphosphates, etc.

Specific examples of the marketed products of such anionic surfactants having a fluoroalkyl group include SARFRON S-111, S-112 and S-113, which are manufactured by Asahi Glass Co., Ltd.; FLUORAD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

The added amount of an anionic surfactant is from 0.5 to 10% by weight based on the weight of the aqueous medium.

The resin constituting the particulate resin A is not particularly limited. For example, resins such as vinyl resins, polyurethane resins, epoxy resins, polyester resins, polyamide resins, polyimide resins, silicone resins, phenolic resins, melamine resins, urea resins, aniline resins, ionomer resins, and polycarbonate resins can be used. Among these resins, vinyl resins, polyurethane resins, and epoxy resins can be preferably used because fine spherical resin particles can be easily prepared.

Specific examples of the vinyl resins include styrene-(meth)acrylate copolymers, styrene-butadiene copolymers, (meth)acrylic acid-acrylate copolymers, styrene-acrylonitrile copolymers, styrene-maleic anhydride copolymers, styrene-(meth)acrylic acid copolymers, etc.

The particulate resin A can be prepared by any known methods. It is preferable to use an aqueous resin dispersion for the particulate resin A. When preparing an aqueous vinyl resin dispersion for use as the particulate resin A, a method in which one or more vinyl monomers are polymerized using a polymerization method such as suspension polymerization methods, emulsion polymerization methods, seed polymerization methods and dispersion polymerization methods can be preferably used.

In a case where the particulate resin A is a resin prepared by a polyaddition or polycondensation reaction, such as polyester resins, polyurethane resins, and epoxy resins, a method including dispersing one or more precursors (such as monomers and oligomers) or a solution thereof in an aqueous medium in the presence of a dispersant; and heating the dispersion or adding a crosslinking agent thereto to crosslink the precursors, resulting in formation of an aqueous resin dispersion can be used. Alternatively, a method including dissolving an emulsifier in one or more precursors (such as monomers and oligomers) or a solution thereof; and adding an aqueous medium thereto to perform phase inversion emulsification, resulting in formation of an aqueous resin dispersion can also be used.

In a case where the particulate resin A is a resin other than the above-mentioned resins (such as vinyl resins, polyester resins, polyurethane resins and epoxy resins), a method including pulverizing and classifying a resin using a pulverizer such as mechanical rotation pulverizers, and jet air pulverizers to prepare a particulate resin A; and dispersing the particulate resin A in an aqueous medium in the presence of a dispersant, resulting in formation of an aqueous resin dispersion can be used. Alternatively, a method including spraying a resin solution to prepare a particulate resin A; and then dispersing the particulate resin A in an aqueous medium in the presence of a dispersant, resulting in formation of an aqueous resin dispersion can also be used. In addition, a method including adding a poor solvent to a resin solution or cooling a resin solution prepared by dissolving a resin in a solvent while heating the solvent, to prepare a particulate resin A; and dispersing the particulate resin A in an aqueous medium in the presence of a dispersant, resulting in formation of an aqueous resin dispersion can also be used. Further, a method including dispersing (emulsifying) a resin solution in an aqueous medium in the presence of a dispersant; and removing the solvent from the emulsion by heating or depressurizing the emulsion to prepare an aqueous resin dispersion can also be used. Furthermore, a method including dissolving an emulsifier in a resin solution; and adding an aqueous medium thereto to perform phase inversion emulsification, resulting in formation of an aqueous resin dispersion can also be used.

When the particulate resin A is prepared, the above-mentioned anionic surfactants can be used as dispersants, and resins having an anionic group such as carboxyl groups and carboxylic acid salt groups can be used for the particulate resin A.

The particulate resin A preferably has a volume average particle diameter of from 10 to 25 nm.

The amount of the particulate resin A added to the aqueous medium is preferably from 0.5 to 10% by weight based on the weight of the aqueous medium. When the added amount is smaller than 0.5% by weight, it is likely that the resultant toner does not satisfy relationship (2). In contrast, when the added amount is larger than 10% by weight, the particulate resin A tends to be easily released from toner particles.

Next, the particulate resin B will be explained. It is preferable that the particulate resin B is not compatible with a polyester resin included in the toner as a toner constituent so that the particulate resin B is located on the surface of mother toner particles.

Specific examples of such resins incompatible with polyester resins include styrene-methyl (meth)acrylate copolymers, styrene-ethyl (meth)acrylate copolymers, styrene-butyl (meth)acrylate copolymers, styrene-octyl acrylate copolymers, styrene-methyl α-chloromethacrylate copolymers, styrene-acrylonitrile copolymers, styrene-acrylonitrile-indene copolymers, styrene-p-chlorostyrene copolymers, styrene-propylene copolymers, styrene-vinyl toluene copolymers, styrene-vinyl naphthalene copolymers, styrene-vinyl methyl ketone copolymers, styrene-butadiene copolymers, styrene-isoprene copolymers, styrene-maleic acid copolymers, styrene-maleate copolymers, etc. These resins can be used alone or in combination. In addition, when such resins as mentioned above are synthesized, monomers having plural vinyl groups can be copolymerized therewith. Specific examples thereof include sodium salt of sulfate of an ethylene oxide adduct of methacrylic acid (ELEMINOL RS-30 from Sanyo Chemical Industries Ltd.), divinyl benzene, 1,6-hexaneidol diacrylate, etc.

The resin constituting the particulate resin B may be the same as or different from the resin constituting the particulate resin A.

The particulate resin B can be prepared by the methods mentioned above for use in preparing the particulate resin A. In this regard, in order that the particulate resin B easily adheres to mother toner particles, the particulate resin B preferably has a cationic, nonionic or ampholytic property. When a particulate resin B having such a property is added to an aqueous medium, the particulate resin B is easily agglomerated. Therefore, it is preferable that at first the particulate resin B is dispersed in an aqueous medium, and then the first liquid is emulsified in the aqueous medium.

In order that the particulate resin B has a cationic, nonionic or ampholytic property, a cationic, nonionic or amphoteric surfactant is preferably used for preparing the particulate resin B. Alternatively, it is preferable to use a resin having a cationic group such as amino groups and ammonium groups as the particulate resin B.

Specific examples of cationic surfactants for use in preparing the particulate resin B include amine salt type surfactants such as alkyl amine salts, amino alcohol fatty acid derivatives, and imidazoline; and quaternary ammonium salt type surfactants such as alkyltrimethyl ammonium salts, dialkyldimethyl ammonium salts, alkyldimethylbenzyl ammonium salts, pyridinium salts, alkylisoquinolinium salts, and benzethonium chloride, but are not limited thereto. Among these surfactants, cationic surfactants having a fluoroalkyl group are preferably used.

Specific examples of such cationic surfactants having a fluoroalkyl group include primary, secondary and tertiary aliphatic amino acids having a fluoroalkyl group, quaternary aliphatic ammonium salts such as perfluoroalkyl(C6-C10) sulfoneamidepropyltrimethylammonium salts, benzalkonium salts, benzethonium chloride, pyridinium salts, and imidazolinium salts, but are not limited thereto.

Specific examples of the marketed products of cationic surfactants having a fluoroalkyl group include SARFRON S-121 (from Asahi Glass Co., Ltd.); FLUORAD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Specific examples of nonionic surfactants for use in preparing the particulate resin B include fatty acid amide derivatives, and polyhydric alcohol derivatives, but are not limited thereto.

Suitable ampholytic surfactants include alanine, dodecylbis(aminoethyl)glycin, bis(octylaminoethyle)glycin, and N-alkyl-N,N-dimethylammonium betaine.

The particulate resin B preferably has a volume average particle diameter of from 100 to 250 nm.

The added amount of the particulate resin B is preferably from 0.5 to 5% by weight, and more preferably from 1 to 4% by weight, based on the total weight of the toner constituents. When the added amount of the particulate resin B is smaller than 0.5% by weight, it is likely that the resultant toner does not satisfy relationship (1). In contrast, when the added amount of the particulate resin B is larger than 5% by weight, the particulate resin B tends to be easily released from the surface of the toner particles.

In the present application, the volume average particle diameter of the particulate resins A and B is measured with a laser diffraction/scattering particle diameter distribution measuring instrument LA-920 from Horiba Ltd.

The toner constituents for use in preparing the toner of the present invention preferably include a polyester prepolymer having a functional group capable of reacting with an active hydrogen atom. Specifically, by reacting a polyester prepolymer included in the second liquid with a compound having an active hydrogen atom, a modified polyester resin can be formed. Such a modified polyester resin serves as a binder resin of the toner, and thereby occurrence of a problem in that the particulate resin B and/or the particulate inorganic material are embedded into the mother toner particles can be prevented. Among various modified polyester resins, urea-modified polyester resins are preferably used because of having an advantage such that the molecular weight of high molecular weight components thereof can be easily adjusted, and a good low temperature fixability can be imparted to the resultant toner (oil-less toner).

Specific examples of the functional groups capable of reacting with an active hydrogen atom include isocyanate groups, epoxy groups, carboxyl groups, and chlorocarbonyl groups, but are not limited thereto. These groups can be included in a compound alone or in combination. Among these groups, isocyanate groups are preferable because of producing urea-modified polyester resins.

Specific examples of the groups having an active hydrogen atom include hydroxyl groups (alcoholic hydroxyl groups and phenolic hydroxyl groups), amino groups, carboxyl groups, and mercapto groups, but are not limited thereto. Among these groups, amino groups are preferable because of producing urea-modified polyester resins.

When preparing the toner of the present invention, a compound having an active hydrogen atom (for example, a toner constituent having an active hydrogen atom) can be dissolved or dispersed in an organic solvent together with toner constituents such as binder resins, colorants and release agents, to prepare the first liquid. Alternatively, such a compound may be included in the aqueous medium, and the first liquid is then added thereto to prepare the second liquid. Alternatively, such a compound may be added to the second liquid.

Hereinafter, an example in which a polyester prepolymer (hereinafter referred to as prepolymer (A)) having an isocyanate group serving as a functional group capable of reacting with an active hydrogen atom, and an amine serving as a compound having an active hydrogen atom are used will be explained.

Prepolymers (A) can be prepared by reacting a polyester, which is prepared by subjecting a polyol and a polycarboxylic acid to a polycondensation reaction and which has an alcoholic hydroxyl group, with a polyisocyanate.

Suitable polyols (PO) for use in preparing polyester resins include diols (DIO), polyols (TO) having three or more hydroxyl groups, and mixtures of DIO and TO. Preferably, diols (DIO) alone or mixtures of a diol (DIO) and a small amount of polyol (TO) are used.

Specific examples of the diols (DIO) include alkylene glycols, condensates of alkylene glycols, alicyclic diols, alkylene oxide adducts of alicyclic diols, bisphenols, and alkylene oxide adducts of bisphenols, but are not limited thereto.

Specific examples of the alkylene glycols include ethylene glycol, 1,2-propylene glycol, 1,3-propylene glycol, 1,4-butanediol and 1,6-hexanediol.

Specific examples of the condensates of alkylene glycols include diethylene glycol, triethylene glycol, dipropylene glycol, polyethylene glycol, polypropylene glycol and polytetramethylene glycol.

Specific examples of the alicyclic diols include 1,4-cyclohexane dimethanol and hydrogenated bisphenol A.

Specific examples of the alkylene oxide adducts of alicyclic dials include adducts of the alicyclic dials mentioned above with an alkylene oxide (e.g., ethylene oxide, propylene oxide and butylene oxide).

Specific examples of the bisphenols include bisphenol A, bisphenol F and bisphenol S.

Specific examples of the alkylene oxide adducts of bisphenols include adducts of the bisphenols mentioned above with an alkylene oxide (e.g., ethylene oxide, propylene oxide and butylene oxide).

These diols can be used alone or in combination.

Among these diols, alkylene glycols having 2 to 12 carbon atoms and alkylene oxide adducts of bisphenols are preferable. More preferably, alkylene oxide adducts of bisphenols, and mixtures of an alkylene oxide adduct of a bisphenol and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (e.g., trisphenol PA, phenol novolak and cresol novolak); and adducts of the polyphenols mentioned above with an alkylene oxide such as ethylene oxide, propylene oxide and butylene oxide, but are not limited thereto.

When a mixture of a diol (DIO) and a polyol (TO) is used, the weight ratio (TO/DIO) of the polyol (TO) to the diol (DIO) is preferably from 0.0001 to 0.1 (0.01% to 10%), and more preferably from 0.0001 to 0.01 (0.01% to 1%).

Suitable polycarboxylic acids (PC) for use in preparing polyester resins include dicarboxylic acids (DIC), polycarboxylic acids (TC) having three or more carboxyl groups, and mixtures of DIC and TC. Preferably, mixtures of DIC and TC are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); and aromatic dicarboxylic acids (e.g., phthalic acid, isophthalic acid, terephthalic acid, and naphthalene dicarboxylic acids, but are not limited thereto. These dicarboxylic acids can be used alone or in combination. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids (e.g., trimellitic acid and pyromellitic acid), but are not limited thereto. Among these polycarboxylic acids, aromatic polycarboxylic acids having from 9 to 20 carbon atoms are preferably used.

When a mixture of a dicarboxylic acid (DIC) and a polycarboxylic acid (TC) is used, the weight ratio (TC/DIC) of the polycarboxylic acid (TC) to the dicarboxylic acid (DIC) is preferably from 0.0001 to 0.1 (0.01% to 10%), and more preferably from 0.0001 to 0.01 (0.01% to 1%).

When a polycarboxylic acid (PC) is reacted with a polyol (PO), anhydrides or lower alkyl esters (e.g., methyl esters, ethyl esters or isopropyl esters) of the polycarboxylic acids mentioned above can also be used as the polycarboxylic acid (PC).

When preparing a polyester having an alcoholic hydroxyl group, a method including heating a combination of a polyol and a polycarboxylic acid to a temperature of from 150 to 280° C. in the presence of an esterification catalyst (e.g., tetrabutoxy titanate and dibutyltin oxide) while optionally depressurizing the reaction system to remove water generated by the reaction is preferably used. In this case, the equivalence ratio ([OH]/[COOH]) of the [OH] group of a polyol (PO) to the [COOH] group of a polycarboxylic acid (PC) is from 1/1 to 2/1, preferably from 1/1 to 1.5/1, and more preferably from 1.02/1 to 1.3/1.

Specific examples of the polyisocyanates (PIC) for use in preparing the prepolymer (A) include aliphatic diisocyanates (e.g., tetramethylene diisocyanate, hexamethylene diisocyanate, methyl 2,6-diisocyanatocaproate, octamethylene diisocyanate, decamethylene diisocyanate, dodecamethylene diisocyanate, tetradecamethylene diisocyanate, trimethylhexane diisocyanate, tetramethylhexane diisocyanate); alicyclic diisocyanates (e.g., isophorone diisocyanate and cyclohexylmethane diisocyanate); aromatic diisocianates (e.g., tolylene diisocyanate, diphenylmethane diisocyanate, 1,5-naphthylene diisocyanate, 4,4'-diisocyanato diphenyl, 4,4'-diisocyanato-3,3'-dimethyldiphenyl, 4,4'-diisocyanato-3-methyldiphenylmethane, and 4,4'-diisocyanatodiphenyl ether); aromatic aliphatic diisocyanates (e.g., α,α,α',α',-tetramethyl xylylene diisocyanate); isocyanurates (e.g., tris(isocyanatoalkyl)isocyanurate, and tris(isocyanatocycloalkyl) isocyanurate; blocked polyisocyanates in which the polyisocyanates mentioned above are blocked with phenol derivatives, oximes or caprolactams; etc. These compounds can be used alone or in combination.

When a polyester having an alcoholic hydroxyl group is reacted with a polyisocyanate, the reaction is preferably performed at a temperature of from 40 to 140° C. In this regard, suitable mixing ratio (i.e., the equivalence ratio [NCO]/[OH]) of the [NCO] group of a polyisocyanate (PIC) to the [OH] group of a polyester is from 1/1 to 5/1, preferably from 1.2/1 to 4/1 and more preferably from 1.5/1 to 2.5/1. When the ratio [NCO]/[OH] ratio is larger than 5, the molecular weight of the resultant urea-modified polyester resin excessively increases, and thereby the low temperature fixability of the toner tends to be deteriorated. In contrast, when the ratio is smaller than 1, the molecular weight of the modified polyesters tends to decrease, thereby deteriorating the hot-offset resistance of the toner.

When the prepolymer (A) is prepared, a solvent which is not reactive with the isocyanate used is preferably used. Specific examples of such solvents include aromatic solvents such as toluene and xylene; ketone solvents such as acetone, methyl ethyl ketone, and methyl isobutyl ketone; ester solvents such as ethyl acetate; amide solvents such as dimethylformamide and dimethylacetamide; and ether solvents such as tetrahydrofuran. These solvents can be used alone or in combination.

The weight average molecular weight of the prepolymer (A) is preferably from $3\times10^3$ to $4\times10^4$, and more preferably from $4\times10^3$ to $3\times10^4$. When the weight average molecular weight is lower than $3\times10^3$, the high temperature preservability of the resultant toner tends to deteriorate. In contrast, when the weight average molecular weight is higher than $4\times10^4$, the low temperature fixability of the resultant toner tends to deteriorate.

The content of a unit derived from a polyisocyanate in the prepolymer (A) is from 0.5 to 40% by weight, preferably from 1 to 30% by weight and more preferably from 2 to 20% by weight. When the content is lower than 0.5% by weight, the hot offset resistance of the toner tends to deteriorate. In contrast, when the content is higher than 40% by weight, the low temperature fixability of the toner tends to deteriorate.

The average number of the isocyanate group included in a molecule of the prepolymer (A) is generally not less than 1, preferably from 1.2 to 5, and more preferably from 1.5 to 4. When the average number of the isocyanate group is smaller than 1, the molecular weight of the resultant urea-modified polyester tends to decrease, thereby deteriorating the hot offset resistance of the resultant toner.

Urea-modified polyester resins for use as the binder resin of the toner of the present invention can be prepared by reacting a polyester prepolymer (A) having an isocyanate group with an amine (B).

Specific examples of the amines (B) include diamines (B1), polyamines (B2) having three or more amino groups, amino alcohols (B3), amino mercaptans (B4), amino acids (B5), and mixtures thereof. Among these amines, diamines (B1) and mixtures of a diamine and a polyamine (B2) are preferably used.

Specific examples of the diamines include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophorone diamine); aliphatic diamines (e.g., ethylene diamine, tetramethylene diamine and hexamethylene diamine); etc. These diamines can be used alone or in combination.

Specific examples of the polyamines (B2) having three or more amino groups include diethylene triamine, triethylene tetramine, etc. These polyamines can be used alone or in combination.

Specific examples of the amino alcohols (B3) include ethanol amine, hydroxyethyl aniline, etc. These amino alcohols can be used alone or in combination.

Specific examples of the amino mercaptan (B4) include aminoethyl mercaptan, aminopropyl mercaptan, etc. These amino mercaptans can be used alone or in combination.

Specific examples of the amino acids (B5) include aminopropionic acid, aminocaproic acid, etc. These amino acids can be used alone or in combination.

In addition, blocked amines (B6) in which the amino groups of the amines (B1-B5) mentioned above are blocked can also be used.

Specific examples of the blocked amines (B6) include ketimine compounds which are prepared by reacting one of the amines (B1-B5) mentioned above with a ketone such as acetone, methyl ethyl ketone and methyl isobutyl ketone; oxazolidine compounds, etc. These blocked amines can be used alone or in combination.

The mixing ratio (i.e., the equivalence ratio [NCO]/[NHx]) of the [NCO] group of the prepolymer (A) having an isocyanate group to the [NHx] group of the amine (B) is from 1/3 to 3/1, preferably from 1/2 to 2/1 and more preferably from 2/3 to 3/2. When the mixing ratio is lower than 1/3 or higher than 3/1, the molecular weight of the resultant urea-modified polyester tends to decrease, resulting in deterioration of the hot offset resistance of the resultant toner.

The urea-modified polyester resins for use in the toner can include a urethane bond as well as a urea bond. A urethane bond can be formed by adding an alcohol in addition to an amine. The equivalence ratio (UT/UR) of the urethane bond (UT) to the urea bond (UR) is from 0/10 to 9/1, preferably from 1/4 to 4/1, and more preferably from 4/6 to 7/3. When the equivalence ratio is greater than 9/1, the hot offset resistance of the resultant toner tends to deteriorate.

When a prepolymer (A) is reacted with an amine (B), known catalysts such as dibutyltin laurate and dioctyltin laurate can be used. The reaction time is determined depending on the reactivity of the isocyanate group of the polyester prepolymer (A) with the amine (B) used, and is generally from 10 minutes to 40 hours, and preferably from 2 hours to 24 hours. The reaction temperature is generally from 0 to 150° C., and preferably from 40 to 98° C.

The molecular weight of the urea-modified polyesters can be controlled using a molecular chain extension inhibitor, if desired. Specific examples of the molecular chain extension inhibitor include monoamines (e.g., diethyl amine, dibutyl amine, butyl amine and lauryl amine), and blocked amines prepared by blocking the monoamines mentioned above.

The toner constituents preferably include a polyester prepolymer having a functional group capable of reacting with an active hydrogen atom, and an unmodified polyester resin so that the resultant toner has good low temperature fixability and images produced by the toner have high glossiness. The weight ratio (P/U) of the prepolymer (P) to the unmodified polyester (U) is preferably from 5/95 to 25/75, and more preferably from 10/90 to 25/75. When the weight ratio (P/U) is less than 5/95, the offset resistance of the resultant toner tends to deteriorate. In contrast, when the weight ratio (P/U) is greater than 25/75, the low temperature fixability of the toner and glossiness of toner images tend to deteriorate.

It is preferable that the toner constituents further include a modified layered inorganic material, and the first liquid has a Casson yield value of from 1 to 100 Pa at 25° C. In this regard, since such a modified layered inorganic material has a proper hydrophobic property, the first liquid has a non-Newtonian viscosity, and thereby deformed toner particles can be prepared.

As mentioned below, a shear force is applied when the second liquid is prepared. The particle diameter of the oil phase liquid (first liquid) dispersed in the second liquid decreases as the time during which a shear force is applied to the second liquid progresses. By controlling the shear force application time, primary particles having a volume average particle diameter of Dv1 can be prepared. In addition, by weakening the shear force applied to the thus prepared second liquid, the primary particles tend to agglomerate, and secondary particles (i.e., mother toner particles) having a volume average particle diameter Dv2 can be prepared. In this regard, when the Casson yield value is less than 1 Pa, the volume average particle diameter Dv1 decreases, and thereby the primary particles tend to be excessively agglomerated, resulting in serious increase of the difference ΔDv (i.e., Dv2−Dv1). Therefore, the particle diameter distribution of the mother toner particles broadens. In contrast, when the Casson yield value is greater than 100 Pa, the volume average particle diameter Dv1 increases, and thereby the primary particles tend to be insufficiently agglomerated, resulting in serious decrease of the difference ΔDv (i.e., Dv2−Dv1). Therefore, deformed toner particles cannot be prepared, and the particle diameter distribution of the mother toner particles broadens. Therefore, it is preferable to control the Casson yield value of the first liquid at 25° C. so that the difference ΔDv (i.e., Dv2−Dv1) is controlled, thereby controlling the particle form of the mother toner particles and the particle diameter distribution of the mother toner particles.

The content of a modified layered inorganic material in the first liquid is preferably from 0.05 to 10% by weight based on the solid components included in the first liquid. When the content is lower than 0.05% by weight, the first liquid tends to have a Casson yield value of less than 1 Pa at 25° C. In contrast, when the content is higher than 10% by weight, the first liquid tends to have a Casson yield value of greater than 100 Pa at 25° C.

The toner constituents used for preparing the first liquid can further include other toner constituents such as colorants, release agents, charge controlling agents, and cleanability improving agents. In this regard, the first liquid does not necessarily include all the toner constituents. Specifically, for example, a method, in which the toner constituents, which are not included in the first liquid, are dissolved or dispersed in a solvent to prepare a third liquid, and then the first liquid and the third liquid are emulsified in an aqueous medium to prepare a second liquid, can be used.

The organic solvent used for preparing the first liquid preferably has a boiling point of not higher than 150° C. so that the solvent can be easily removed from the second liquid by quickly evaporating. Specific examples of such organic solvents include toluene, xylene, benzene, carbon tetrachloride, methylene chloride, 1,2-dichloroethane, 1,1,2-trichloroethane, trichloroethylene, chloroform, chlorobenzene, dichloroethylidene, methyl acetate, ethyl acetate, methyl ethyl ketone, and methyl isobutyl ketone. These solvents can be used alone or in combination. In particular, toluene, xylene, methylene chloride, 1,2-dichloroethane, chloroform, carbon tetrachloride, and ethyl acetate are preferably used. Further, ethyl acetate is more preferably used.

The added amount of an organic solvent is preferably from 40 to 300 parts by weight, preferably from 60 to 140 parts by weight, and more preferably from 80 to 120 parts by weight, based on 100 parts by weight of the toner constituents. When the added amount of an organic solvent is smaller than 40 parts by weight, the first liquid tends to have a Casson yield value of greater than 100 Pa at 25° C. In contrast, when the added amount of an organic solvent is larger than 300 parts by weight, the first liquid tends to have a Casson yield value of less than 1 Pa at 25° C.

When the first liquid is emulsified in an aqueous medium, any known dispersing machines such as low-speed shearing-type dispersing machines, and high-speed shearing-type dispersing machines can be used.

The weight ratio (Aq/T) of the aqueous medium (Aq) to the toner constituents (T) is generally from 50/100 to 2000/100, and preferably from 100/100 to 1000/100. When the weight ratio is less than 50/100, it becomes difficult to well disperse the toner constituents in the aqueous medium, and thereby mother toner particles having the desired particle diameter cannot be prepared. In contrast, when the weight ratio is greater than 2000/100, it becomes difficult to prepare deformed mother toner particles.

The aqueous medium for use in preparing the second liquid can include an inorganic dispersant, a polymeric protection colloid, etc.

Specific examples of such inorganic compounds include tricalcium phosphate, calcium carbonate, titanium oxide, colloidal silica, and hydroxyapatite. When tricalcium phosphate is used, it is preferable to remove tricalcium phosphate from the resultant mother toner particles using a method including dissolving residual tricalcium phosphate using hydrochloric acid, etc., and then washing the resultant mother toner particles with water; or a method using an enzyme.

Further, it is preferable to stabilize the emulsion or dispersion using a polymeric protection colloid in combination with the particulate resins and inorganic dispersants.

Specific examples of such polymeric protection colloids include polymers and copolymers prepared using monomers such as vinyl monomers having a carboxyl group (e.g., acrylic acid, methacrylic acid, α-cyanoacrylic acid, α-cyanomethacrylic acid, itaconic acid, crotonic acid, fumaric acid, maleic acid, and maleic anhydride); (meth)acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide); alkyl vinyl ethers (e.g., vinyl methyl ether, vinyl ethyl ether and vinyl propyl ether); vinyl carboxylate monomers (e.g., vinyl acetate, vinyl propionate and vinyl butyrate); (meth) acrylic amide monomers (e.g., acrylamide, methacrylamide and diacetoneacrylamide) and their methylol compounds; (meth) acrylic acid chloride monomers (e.g., acrylic acid chloride and methacrylic acid chloride); and vinyl monomers having a nitrogen atom or an alicyclic ring having a nitrogen atom (e.g., vinyl pyridine, vinyl pyrrolidone, vinyl imidazole and ethylene imine).

In addition, polymers such as polyoxyalkylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose, hydroxypropyl cellulose and carboxymethyl cellulose can also be used as polymeric protection colloids.

The method for removing the organic solvent from the second liquid is not particularly limited. For example, a method in which the second liquid is gradually heated to evaporate the organic solvent included in the second liquid; and a method in which the second liquid is sprayed in a dry atmosphere to evaporate the organic solvent, can be used.

By removing the organic solvent from the second liquid, mother toner particles are prepared in the liquid. In this regard, it is preferable to heat the liquid including the mother toner particles to a temperature higher than the glass transition temperature of the polyester resin included in the mother toner particles so that the particulate resin B is not easily released from the mother toner particles. In addition, it is also preferable that after the mother toner particles are prepared and then dried, the mother toner particles are classified. Specific examples of the classifiers include cyclones, decanters, and centrifugal separation machines, but are not limited thereto.

The thus prepared mother toner particles are preferably mixed with an inorganic material (i.e., an external additive) to improve the fluidity and charging properties of the resultant toner.

Next, the developer of the present invention will be explained.

The developer of the present invention includes the toner of the present invention. The developer may be a one-component developer consisting essentially of the toner, or a two-component developer including the toner and a carrier, which can be selected from known carrier materials.

Next, the image forming method of the present invention will be explained.

The image forming method of the present invention includes at least an electrostatic latent image forming process (e.g., combination of a charging process and a light irradiating process), a developing process, a transferring process, a fixing process, and a cleaning process. If desired, a discharging process, a toner recycling process and a controlling process can be optionally performed.

Next, the processes and the devices used therefor will be explained in detail.

In the electrostatic latent image forming process, an electrostatic latent image is formed on an image bearing member. The image bearing member is not particularly limited with respect to the constitutional materials, shape, structure, size, etc. For example, with respect to the shape, drum-form, sheet-form, and endless belt-form image bearing members can be used, but drum form photoreceptors are preferably used therefor.

The image bearing member is preferably a photoreceptor such as inorganic photoreceptors including an inorganic photosensitive material such as amorphous silicon and selenium; and organic photoreceptors (OPCs) including an organic photosensitive material such as polysilane and phthalopolymethine. Among these photosensitive materials, amorphous silicon is preferably used because of having a relatively long life.

An electrostatic latent image can be formed on the image bearing member by charging the surface of the image bearing member and then irradiating the charged surface with imagewise light. In this regard, a combination of a charger configured to charge the image bearing member and a light irradiating device configured to irradiate the charged surface of the image bearing member with imagewise light is typically used as an electrostatic latent image forming device.

The charging process is performed by applying a voltage to the image bearing member using a charger. The charger is not particularly limited. Specific examples of the charger include contact chargers such as conductive or semiconductive rollers, brushes, films and rubber blades; non-contact chargers utilizing corona discharging such as corotrons and scorotrons.

In the light irradiating process, a light irradiating device irradiates the charged image bearing member with imagewise light to form an electrostatic latent image on the image bearing member.

The light irradiating device is not particularly limited, and any known devices can be used therefor. Specific examples thereof include optical systems for use in copiers, rod lens arrays, optical systems using a laser, a liquid crystal shutter, etc.

Light irradiating methods including irradiating the charged image bearing member with light from the inside (backside) of the image bearing member can also be used.

In the developing process, an electrostatic latent image formed on an image bearing member is developed with a developer including the toner of the present invention using a developing device to form a toner image (i.e., a visual image) on the image bearing member.

The developing device is not particularly limited, and any known developing devices can be used as long as the devices can develop an electrostatic image with a developer including the toner of the present invention. For example, devices which contain a developer including the toner of the present invention and which applies the toner to an electrostatic image by contacting the toner with the electrostatic image or without contacting the toner therewith. The developing device is a dry developing device, and may be a monochrome developing device capable of forming monochrome toner images or a multi-color developing device capable of forming plural color toner images. Specifically, the developing device includes at least an agitator configured to agitate the developer to charge the toner, and a developing member configured to bear the developer using a rotatable magnet roller to develop an electrostatic latent image with the developer.

In a developing device containing a two-component developer, the toner of the present invention and a carrier are mixed and agitated to frictionally charge the toner. The developer including the toner is born on the surface of the developing roller due to the magnetic force of the magnet roller located in the developing roller while forming a magnetic brush. Since the developing roller is set close to the image bearing member (such as photoreceptor drums), some of particles of the toner in the magnetic brush is electrically attracted by an electrostatic latent image on the image bearing member, resulting in transferring of the toner particles to the electrostatic latent image. Thus, the latent image is developed with the toner, resulting in formation of a toner image (i.e., a visual image) on the surface of the image bearing member.

In the transferring process, a toner image formed on the image bearing member is transferred onto a receiving material. It is preferable to primarily transfer a toner image on the image bearing member onto an intermediate transfer medium, followed by secondarily transferring the toner image onto a receiving material. This transferring method is preferably used for an image forming method in which plural color toner images such as full color toner images are formed. Specifically, the image forming method is such that plural color toner images are formed on one or plural image bearing members, and the plural color toner images are sequentially transferred onto an intermediate transfer medium (primary transfer), resulting in formation of a combined color toner image on the intermediate transfer medium. The combined color toner image is then transferred (secondary transfer) onto a receiving material.

The transferring process is typically performed using a transferring device which charges the image bearing member. The transferring device preferably includes a primary transferring member configured to transfer one or more color toner images on the image bearing member or members to the intermediate transfer medium to form a combined color toner image, and a secondary transferring member configured to transfer the combined color toner image on the intermediate transfer medium to a receiving material. Any known intermediate transfer media can be used, and intermediate transfer belts are preferably used as the intermediate transfer medium.

The transferring device preferably includes one or more transfer members configured to charge a toner image so as to be easily transferred to a receiving material. Specific examples of the transfer members include corona discharging members, transfer belts, transfer rollers, pressure rollers, adhesive transfer members, etc.

Any known materials (such as paper sheets) for use as receiving materials for conventional image forming apparatus can be used as the receiving material for use in the image forming apparatus of the present invention.

In the fixing process, a toner image transferred on a sheet of a receiving material is fixed thereto by a fixing device. When plural color toner images are sequentially transferred onto a receiving material, the fixing operation may be performed on each of the transferred color toner images, or the overlaid plural color toner images (i.e., the combined color toner image) at the same time.

The fixing device is not particularly limited, but heat/pressure fixing devices capable of heating and pressing are preferably used. For example, combinations of a heat roller and a pressure roller and combinations of a heat roller, a pressure roller and an endless belt can be preferably used. The temperature of the heating members (such as heat rollers) is preferably from 80 to 200° C.

A light fixing device configured to fix a toner image using light can be used alone or in combination of a heat/pressure fixing device for the image forming apparatus for use in the present invention.

In the discharging process, charges remaining on the image bearing member even after the transferring process are removed by applying a bias or light to the image bearing member using a discharging device. Any known discharging devices such as discharging lamps and chargers can be used.

In the cleaning process, toner particles remaining on the image bearing member even after the transferring process are removed therefrom using a cleaning member of a cleaning device. The cleaning device is not particularly limited, and any known cleaners such as magnetic brush cleaners, electrostatic brush cleaners, magnetic roller cleaners, blade cleaners, brush cleaners and web cleaners can be used. Among these cleaners, blade cleaners are preferably used for the cleaning device of the image forming apparatus for use in the present invention.

In the toner recycling process, the toner particles collected in the cleaning process are fed to the developing device to be reused. The toner recycling process is performed using a known recycling device such as powder feeding devices.

The controlling process is a process for controlling the above-mentioned processes, which is performed using a controller. Specific examples of the controller include sequencers, and personal computers.

The process cartridge of the present invention includes at least an image bearing member configured to bear an electrostatic latent image, and a developing device configured to develop the electrostatic latent image with a developer including the toner of the present invention, which are united with each other. The process cartridge is detachably attachable to an image forming apparatus. The process cartridge of the present invention can include other devices such as chargers and cleaning devices, which are also united with the image bearing member and the developing device.

Next, a first embodiment of the image forming apparatus will be explained by reference to a drawing.

FIG. 1 is a schematic view illustrating an embodiment of the image forming apparatus for use in the present invention.

In FIG. 1, an image forming apparatus 100A includes a photoreceptor drum 10 (hereinafter referred to as a photoreceptor) serving as an image bearing member; a charging roller 20 serving as a charging member of a charging device; a light irradiator (not shown) serving as the latent image forming device emitting imagewise light L; a developing device 40 serving as an image developing device; an intermediate transfer medium 50; a cleaning blade 60 serving as a cleaning member of a cleaning device; and a discharging lamp 70 serving as a discharging member of a discharging device.

The intermediate transfer belt 50 is an endless belt which is rotated in a direction indicated by an arrow by three rollers 51 arranged therein while tightly stretched by the rollers. At least one of the three rollers 51 serves as a transfer bias roller configured to apply a transfer bias (primary transfer bias) to the intermediate transfer belt 50. A cleaning device including a cleaning blade 90 is arranged in the vicinity of the intermediate transfer belt 50 to clean the surface of the intermediate transfer belt.

In the vicinity of the intermediate transfer belt 50, a transfer roller 80 is provided to apply a transfer bias (a second transfer bias) to a receiving material 95 on which a toner image is to be transferred. In addition, a corona charger 58 is provided to charge a toner image on the intermediate transfer belt 50. The corona charger 58 is arranged at a location between the primary transfer position at which the photoreceptor 10 faces the intermediate transfer belt 50 and the secondary transfer position at which the intermediate transfer belt 50 faces the receiving material 95.

The developing device 40 includes a developing belt 41; a black developing unit 45K; a yellow developing unit 45Y; a magenta developing unit 45M; and a cyan developing unit 45C. Each of the developing units 45 includes a developer containing portion 42 (42K, 42Y, 42M or 42C) containing a developer including a toner, a developing roller 44 (44K, 44Y, 44M or 44C) configured to bear and transport the developer, and a developer supplying roller 43 (43K, 43Y, 43M or 43C) configured to supply the developer in the developer containing portion 42 to the developing roller 44. The developing belt 41 is rotatably supported by plural rollers to transport the toner to the photoreceptor 10 so that an electrostatic latent image on the photoreceptor is developed with the toner.

In the image forming apparatus 100A, the surface of the photoreceptor 10 is uniformly charged with the charging roller 20. The light irradiator 30 irradiates the charged surface of the photoreceptor 10 with imagewise light to form an electrostatic latent image on the photoreceptor 10. The developing device 40 develops the latent image with color toners using the toner transported by the developing belt 41 to sequentially form color toner images on the photoreceptor 10. In this regard, the four color toners are adhered to the respective positions (predetermined positions) of the developing belt 41. The color toner images thus formed on the photoreceptor 10 are transferred to the intermediate transfer medium 50 (first transfer) to form a combined color toner image (e.g., a full color toner image) thereon while at least one of the rollers 51 applies a transfer bias thereto. The toner image formed on the intermediate transfer medium 50 is then transferred to the receiving material 95 (second transfer). Particles of the toner remaining on the photoreceptor 10 after the transfer operation are removed with the cleaner 60, and charges remaining on the photoreceptor 10 are removed by irradiating the photoreceptor 10 with light using the discharging lamp 70. In addition, toner particles remaining on the developing belt 41 even after the developing process are removed therefrom by a cleaner (not shown).

Figure 2:
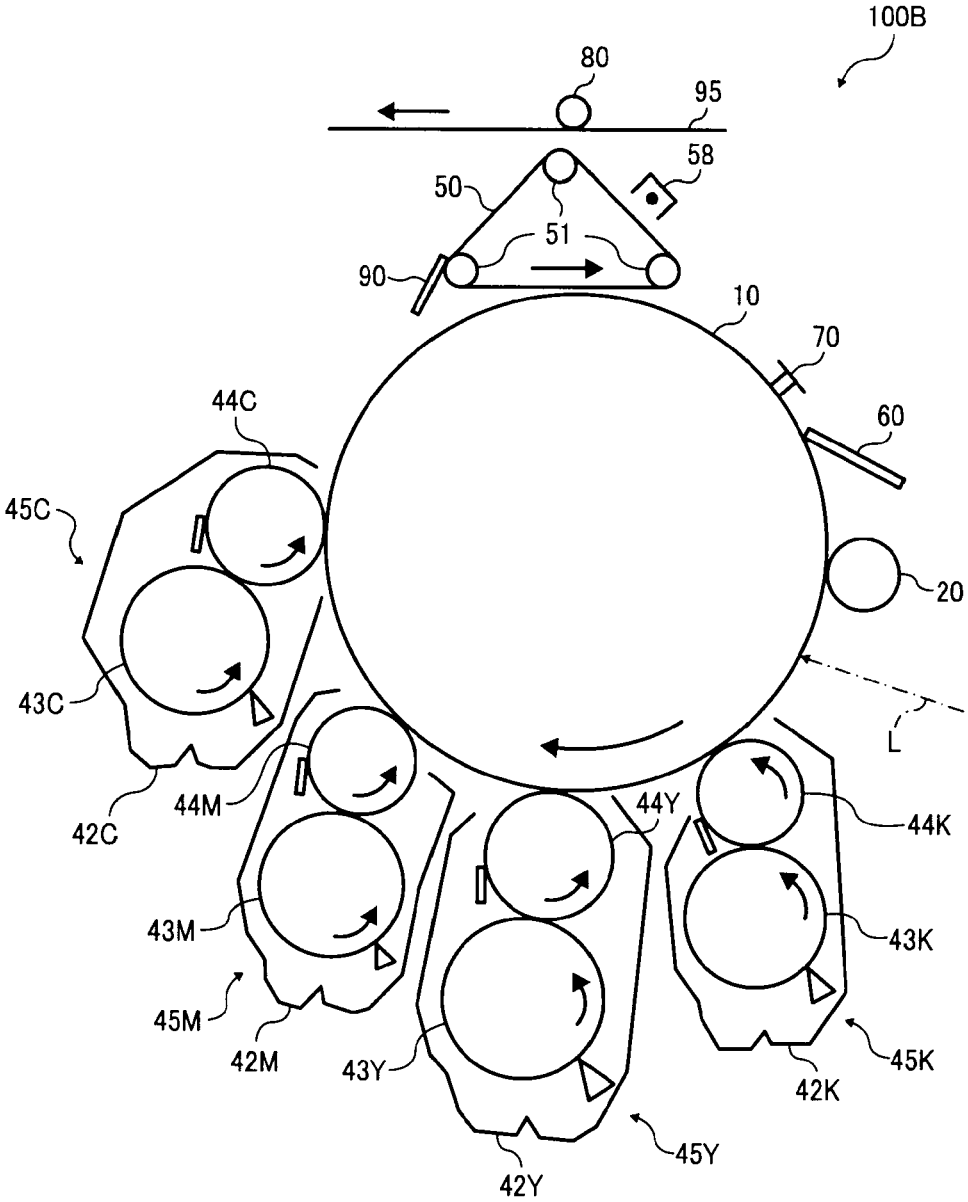
FIG. 2 is a modified version of the image forming apparatus illustrated in FIG. 1.

A second embodiment of the image forming apparatus for use in the present invention is illustrated in FIG. 2. In FIG. 2, an image forming apparatus 100B has the same configuration as that of the image forming apparatus illustrated in FIG. 1 except that the black, yellow, magenta and cyan developing units 45K, 45Y, 45M and 45C face the photoreceptor 10 and the developing belt 41 is not used. The developing roller 44 transports the developer supplied by the developer supplying roller 43 to a development region at which the developing roller faces the photoreceptor 10. The operation of the image forming apparatus is substantially the same as that of the image forming apparatus illustrated in FIG. 1, and therefore explanation of the operation of the second embodiment is omitted.

Figure 3:
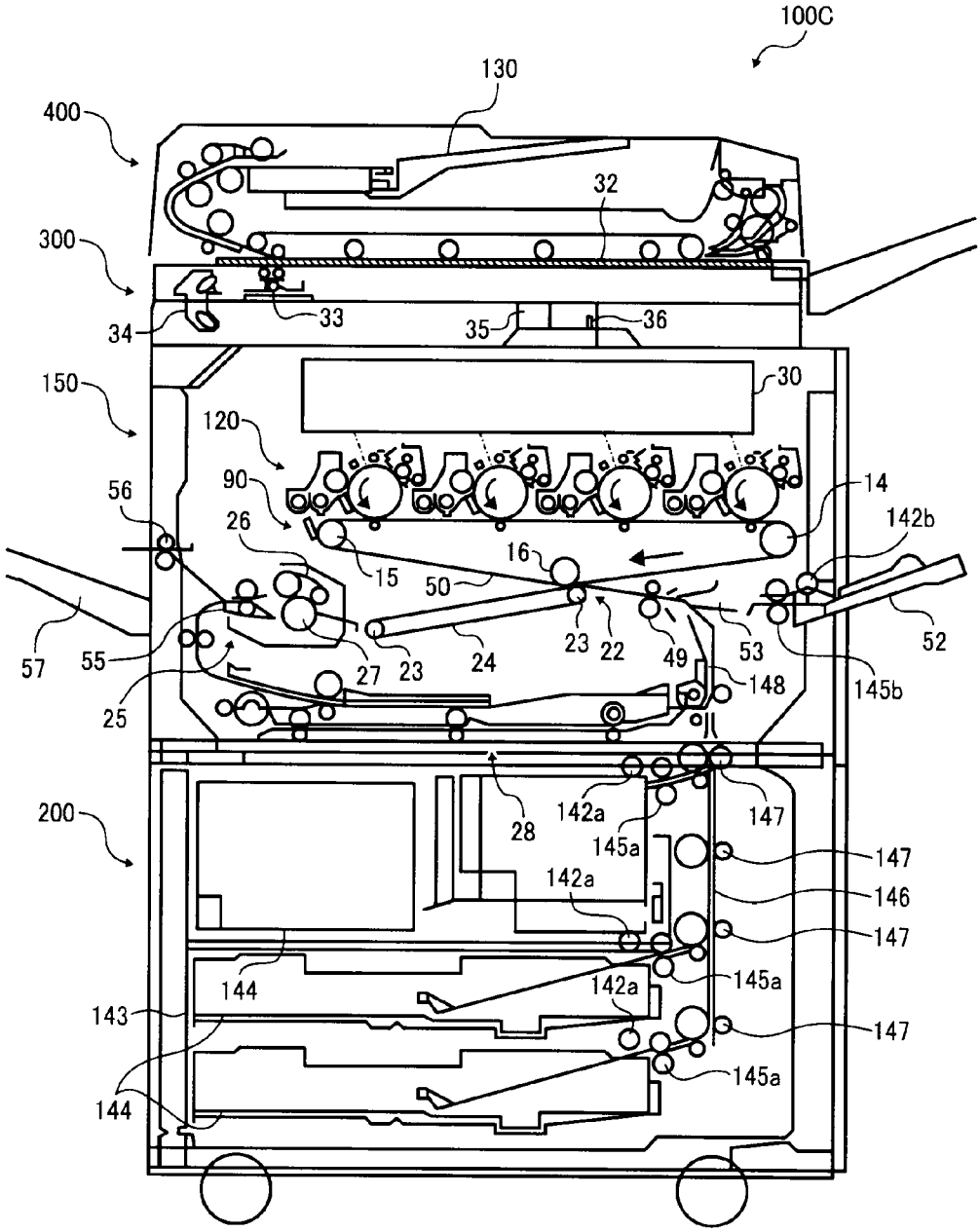
FIG. 3 is a schematic view illustrating another image forming apparatus for use in the image forming method of the present invention.
Figure 4:
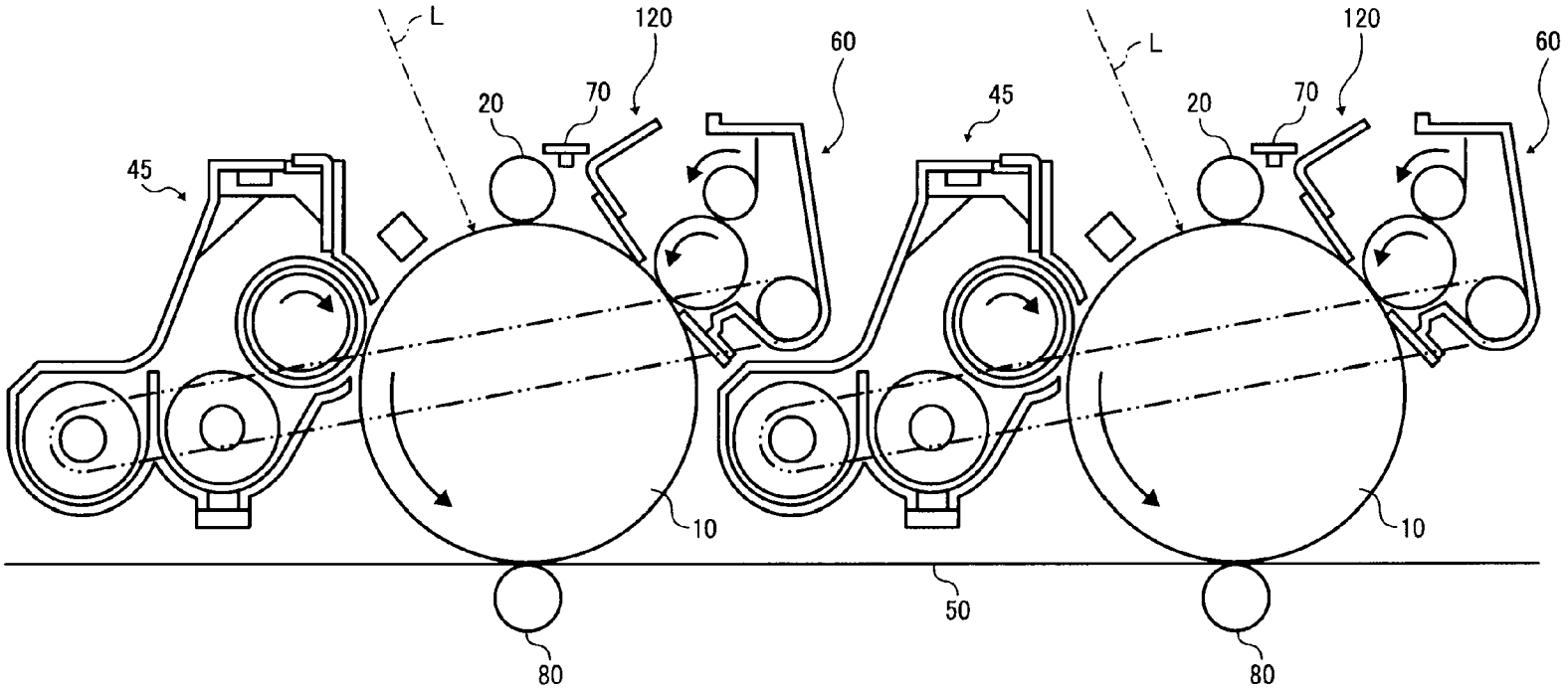
FIG. 4 is an enlarged view of the image forming section of the image forming apparatus illustrated in FIG. 3.

A third embodiment of the image forming apparatus of the present invention is illustrated in FIGS. 3 and 4.

FIG. 3 is the overview of the third embodiment of the image forming apparatus for use in the present invention, which is a tandem-type color image forming apparatus, and FIG. 4 is an enlarged view illustrating the image forming section of the third embodiment.

In FIG. 3, a tandem-type color image forming apparatus 100C includes an image forming section 150, a paper feeding section 200, a scanner 300 and an automatic document feeder 400.

The image forming section 150 includes the endless intermediate transfer medium 50, which is provided at the center of the image forming section 150. The intermediate transfer medium 50 is rotated clockwise by rollers 14, 15 and 16 while tightly stretched by the rollers. The cleaning device 90 is provided near the roller 15 to remove particles of the toner remaining on the surface of the intermediate transfer medium 50.

Four image forming units 120 for forming yellow, magenta, cyan and black toner images are arranged side by side above the intermediate transfer medium 50. As illustrated in FIG. 4, each of the image forming units 120 includes the photoreceptor 10 (i.e., 10Y, 10M, 10C or 10K). The developing device 45 includes four developing devices arranged in the respective four image forming units 120. A light irradiator 30 configured to irradiate the photoreceptors 10 with light to form an electrostatic latent image thereon is arranged above the image forming units 120.

A second transfer device 22 is provided below the intermediate transfer belt 50. The second transfer device 22 includes an endless belt 24 which is rotated while stretched by a pair of rollers 23. The endless belt 24 feeds a receiving material so that the toner images (i.e., a combined color toner image) on the intermediate transfer belt 50 are transferred to the receiving material while sandwiched by the intermediate transfer medium 50 and the endless belt 24.

A fixing device 25 is arranged at a position near the second transfer device 22. The fixing device 25 includes an endless fixing belt 26 and a pressure roller 27, which presses the fixing belt 26.

In addition, a sheet reversing device 28 configured to reverse the receiving material is provided at a position near the fixing device 25, to produce double-sided copies.

Next, the full color image forming operation of the tandem-type color image forming apparatus 100C will be explained.

An original to be copied is set on an original table 130 of the automatic document feeder 400. Alternatively, the original may be directly set on a glass plate 32 of the scanner 300 after the automatic document feeder 400 is opened, followed by closing the automatic document feeder 400. When a start button (not shown) is pushed, the color image of the original set on the glass plate 32 is scanned with a first traveler 33 and a second traveler 34, which move in the right direction in FIG. 3. In the case where the original is set on the table 130 of the automatic document feeder 400, at first the original is fed to the glass plate 32, and then the color image thereon is scanned with the first and second travelers 33 and 34. The first traveler 33 irradiates the color image on the original with light and the second traveler 34 reflects the light reflected from the color image to send the color light image to a sensor 36 via a focusing lens 35. Thus, color image information (i.e., black, yellow, magenta and cyan color image data) is provided.

The black, yellow, magenta and cyan color image data are sent to the respective black, yellow, magenta and cyan color image forming units 120, and black, yellow, magenta and cyan color toner images are formed on the respective photoreceptor drums 10. The toner image forming operation is the same as that mentioned in the image forming apparatus illustrated in FIG. 1.

FIG. 4 is a schematic view illustrating a part of the image forming units 120.

As illustrated in FIG. 4, each of the photoreceptor drums 10 is charged with the charging roller 20, and the charged photoreceptor drum is exposed to imagewise light L emitted by the light irradiating device 30. Thus, electrostatic latent images corresponding to the black, yellow, magenta and cyan color images are formed on the respective photoreceptor drums. The electrostatic latent images are then developed with the respective developing devices 45 using developers including black, yellow, magenta and cyan color toners, each of which is the toner of the present invention, resulting in formation of black, yellow, magenta and cyan color toners on the respective photoreceptor drums. The thus prepared color toner images are then transferred onto the intermediate transfer belt 50 by the transfer rollers 80, resulting in formation of a combined color image on the intermediate transfer belt.

Referring to FIG. 3, in the paper feeding section 200, one of paper feeding rollers 142*a* is selectively rotated to feed the uppermost paper sheet of paper sheets stacked in a paper cassette 144 in a paper bank 143 while the paper sheet is separated one by one by a separation roller 145*a* when plural paper sheets are continuously fed. The paper sheet is fed to a passage 148 in the image forming section 150 through a passage 146 in the paper feeding section 200, and is stopped once by a pair of registration rollers 49. Numeral 147 denotes feed rollers. A paper sheet can also be fed by a feeding roller 142*b* from a manual paper tray 52, and the thus fed paper sheet is fed to a passage 53 after separated one by one by a separation roller 145*b*. The thus fed paper sheet is also stopped once by the registration roller 49. The registration rollers 49 are generally grounded, but a bias can be applied thereto to remove paper dust therefrom.

The combined color toner image thus formed on the intermediate transfer belt 50 is transferred to the paper sheet, which is timely fed by the registration rollers 49, at the contact point of the second transfer device 22 with the intermediate transfer belt. Particles of the toner remaining on the surface of the intermediate transfer belt 50 even after the second image transfer operation are removed therefrom by the cleaner 90.

The paper sheet having the combined color toner image thereon is then fed by the second transfer device 22 to the fixing device 25, and the toner image is fixed on the paper sheet upon application of heat and pressure. The paper sheet bearing a fixed toner image thereon is discharged from the image forming section 150 by a discharge roller 56 while the path is properly selected by a paper path changing pick 55. Thus, a copy is stacked on a tray 57. When a double sided copy is produced, the paper sheet having a toner image on one side thereof is fed to the sheet reversing device 28 to be reversed. The reversed paper sheet is then fed to the second transfer device 22 through the passage 148 so that a second image formed on the intermediate transfer belt 50 is transferred to the other side of the paper sheet by the second transfer device. The second image formed on the other side is also fixed by the fixing device 25 and then the double-sided copy is discharged to the tray 57 by the discharge roller 56.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Polyester

The following components were contained in a reaction vessel equipped with a condenser, an agitator and a nitrogen feed pipe to be subjected to a polycondensation reaction for 8 hours at 230° C. under normal pressure.

| | |
|---|---|
| Ethylene oxide (2 mole) adduct of bisphenol A | 67 parts |
| Propylene oxide (3 mole) adduct of bisphenol A | 84 parts |
| Terephthalic acid | 274 parts |
| Dibutyltin oxide | 2 parts |

The reaction was further performed for 5 hours under a reduced pressure of from 10 to 15 mmHg (1.33 to 2.00 Pa) to prepare a polyester resin (unmodified polyester resin).

It was confirmed that the polyester resin has a number average molecular weight of 2,100, a weight average molecular weight of 5,600, and a glass transition temperature (Tg) of 55° C.

Preparation of Master Batch

The following components were mixed using a HENSCHEL MIXER mixer from Mitsui Mining Co., Ltd.

| | |
|---|---|
| Ion exchange water | 1,000 parts |
| Carbon black (PRINTEX 35 from Degussa A.G. having DBP oil absorption of 42 ml/100 g and pH of 9.5) | 540 parts |
| Polyester resin prepare above | 1,200 parts |

The mixture was kneaded for 30 minutes at 150° C. using a two roll mill. The kneaded mixture was then cooled by rolling, followed by pulverization using a pulverizer from Hosokawa Micron Corp. Thus, a master batch was prepared.

Preparation of Aqueous Dispersion of Particulate Resin A

The following components were contained in a reaction vessel equipped with an agitator and a thermometer to be mixed.

| | |
|---|---|
| Ion exchange water | 683 parts |
| Reactive emulsifier (Sodium salt of sulfate of an ethylene oxide adduct of methacrylic acid, ELEMINOL RS-30 from Sanyo Chemical Industries Ltd.) | 16 parts |
| Styrene | 83 parts |
| Methacrylic acid | 83 parts |
| Butyl acrylate | 110 parts |
| Ammonium persulfate | 1 part |

The mixture was agitated for 15 minutes while the agitator was rotated at a revolution of 400 rpm. As a result, an emulsion was prepared. The emulsion was heated to 75° C. to react the monomers for 5 hours.

Further, 30 parts of a 1% by weight aqueous solution of ammonium persulfate was added to the reaction product, and the mixture was aged for 5 hours at 75° C. Thus, an aqueous dispersion of particulate resin A was prepared.

The volume average particle diameter of the thus prepared particulate resin A was determined using a laser diffraction/scattering particle diameter distribution measuring instrument LA-920 from Horiba Ltd. As a result, the volume average particle diameter of the particulate resin A was 9 nm.

Preparation of Aqueous Dispersion of Particulate Resin B

The following components were contained in a reaction vessel equipped with an agitator and a thermometer to be mixed.

| | |
|---|---|
| Ion exchange water | 683 parts |
| Distearyldimethylammonium chloride (CATION DS from Kao Corporation) | 10 parts |
| Styrene | 138 parts |
| Methacrylic acid | 138 parts |
| Ammonium persulfate | 1 part |

The mixture was agitated for 15 minutes while the agitator was rotated at a revolution of 400 rpm. As a result, an emulsion was prepared. The emulsion was heated to 65° C. to react the monomers for 12 hours.

Further, 30 parts of a 1% by weight aqueous solution of ammonium persulfate was added to the reaction product, and the mixture was aged for 5 hours at 75° C. Thus, an aqueous dispersion of particulate resin B was prepared.

The volume average particle diameter of the thus prepared particulate resin B was determined using the laser diffraction/scattering particle diameter distribution measuring instrument LA-920 from Horiba Ltd. As a result, the volume average particle diameter of the particulate resin B was 62 nm.

Preparation of Toner

The following components were contained in a reaction vessel equipped with an agitator and a thermometer to mix the components.

| | |
|---|---|
| Polyester resin prepare above | 378 parts |
| Carnauba wax (The content thereof is 4% by weight in the toner.) | 110 parts |
| Metal complex of salicylic acid (E-84 from Orient Chemical Industries Co., Ltd.) | 22 parts |
| Ethyl acetate | 947 parts |

The mixture was heated for 5 hours at 80° C. while agitated. The mixture was then cooled to 30° C. over 1 hour.

After the mixture was mixed with 500 parts of the master batch, and 500 parts of ethyl acetate, the resultant mixture was agitated for 1 hour.

Next, 1,324 parts of the thus prepared mixture was fed into a reaction vessel to be subjected to a dispersing treatment using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Thus, a wax dispersion in which the carbon black and carnauba wax are dispersed was prepared.

Next, 1,324 parts of a 65% by weight ethyl acetate solution of the polyester resin prepared above was added to the wax dispersion. The mixture was subjected to the dispersion treatment using the bead mill mentioned above. The dispersion conditions were the same as those mentioned above except that the dispersion operation was performed once (i.e., one pass).

Next, 200 parts of the thus prepared dispersion was mixed with 1 part of a modified layered montmorillonite (CLAYTON APA from Southern Clay Products), in which at least part of interlayer ions is modified with a quaternary ammonium salt having a benzyl group. The mixture was agitated for 30 minutes with a TK HOMODISPER from Tokushu Kika Kogyo Co., Ltd. under a condition of 7,000 rpm in revolution. Thus, a toner constituent dispersion was prepared.

The following components were mixed in a container while agitated to prepare an aqueous medium.

| | |
|---|---|
| Ion exchange water | 660 parts |
| Aqueous dispersion of particulate resin A | 25 parts |
| Aqueous solution of a sodium salt of dodecyldiphenyletherdisulfonic acid (ELEMINOL MON-7 from Sanyo Chemical Industries Ltd., solid content of 48.5%) | 25 parts |
| Ethyl acetate | 60 parts |

When the thus prepared aqueous medium was then mixed with 50 parts of the aqueous dispersion of the particulate resin B prepared above, the aqueous medium was agglomerated.

Next, 150 parts of the aqueous medium, to which the particulate resin B dispersion had been added, was mixed with 1 part of a particulate inorganic material, and the mixture was agitated using a TK HOMOMIXER mixer from Tokushu Kika Kogyo Co., Ltd., whose rotor was rotated at 12,000 rpm. Further, 100 parts of the toner constituent mixture prepared above was added to the mixture, and the mixture was agitated for 10 minutes using the TK HOMOMIXER mixer, whose rotor was rotated at 12,000 rpm.

Thus, an emulsion slurry was prepared.

Next, 100 parts of the emulsion slurry was contained in a flask equipped with a deaerating tube, an agitator, and a thermometer, and heated for 12 hours at 30° C. while agitated by the agitator rotated at a peripheral speed of 20 m/sec to remove the organic solvent from the slurry, followed by aging at 60° C. Thus, a dispersion slurry was prepared.

The thus prepared dispersion slurry was filtered under a reduced pressure.

The thus prepared wet cake was mixed with 300 parts of ion-exchange water and the mixture was agitated for 10 minutes with a TK HOMOMIXER mixer, whose rotor was rotated at a revolution of 12,000 rpm, followed by filtering. Thus, a wet cake (a) was prepared.

The thus prepared wet cake (a) was mixed with 300 parts of ion-exchange water, and the mixture was agitated for 10 minutes with TK HOMOMIXER, whose rotor was rotated at a revolution of 12,000 rpm, followed by filtering. Thus, a wet cake (b) was prepared. This washing operation was performed three times in total.

The thus prepared final wet cake was dried for 48 hours at 45° C. using a circulating air drier, followed by sieving with a screen having openings of 75 μm.

Thus, black mother toner particles were prepared.

One hundred (100) parts of the mother toner particles were mixed with 1 part of a silica A, which has a BET specific surface area of 21 m/g, a moisture content of 0.4% by weight, and a bulk density of 140 g/l, 1.5 parts of a silica B, which has a BET specific surface area of 140 m/g, a moisture content of 0.4% by weight, and a bulk density of 140 g/l, and 0.5 parts of a hydrophobic titanium oxide using a HENSCHEL MIXER mixer (from Mitsui Mining Co., Ltd.).

Thus, a black toner of Example 1 was prepared.

Example 2

The procedure for preparation of the toner in Example 1 was repeated except that the content of the carnauba wax was changed to 3% by weight, and the added amounts of the silicas A and B were changed to 0.95 parts and 1.45 parts, respectively.

Thus, a black toner of Example 2 was prepared.

Example 3

The procedure for preparation of the toner in Example 1 was repeated except that the content of the carnauba wax was changed to 5% by weight, and the added amounts of the silicas A and B were changed to 0.95 parts and 1.45 parts, respectively.

Thus, a black toner of Example 3 was prepared.

Example 4

The procedure for preparation of the toner in Example 1 was repeated except that the content of the carnauba wax was changed to 3% by weight, and the added amounts of the silicas A and B were changed to 1.05 parts and 1.55 parts, respectively.

Thus, a black toner of Example 4 was prepared.

Example 5

The procedure for preparation of the toner in Example 1 was repeated except that the content of the carnauba wax was changed to 5% by weight, and the added amounts of the silicas A and B were changed to 1.05 parts and 1.55 parts, respectively.

Thus, a black toner of Example 4 was prepared.

Comparative Example 1

The following components were mixed in a reaction vessel equipped with an agitator and a thermometer.

| | |
|---|---|
| Ion-exchange water | 100 parts |
| Nonionic emulsifier (EMULGEN 950 from Kao Corporation) | 1 part |
| Anionic emulsifier (NEOGEN R from Dai-ichi Kogyo Seiyaku Co.,Ltd.) | 1.5 parts |

The mixture was heated to 70° C.

Next, each of a mixture of 71 parts of styrene, 25 parts of n-butyl acrylate, and 4 parts of acrylic acid, and 5 parts of a 1% by weight solution of potassium persulfate was dropped into the above-prepared mixture at the same time over 4 hours. The mixture was then reacted for 2 hours at 70° C. Thus, a resin emulsion having a solid content of 50% was prepared.

The following components were mixed in a reaction vessel equipped with an agitator and a thermometer.

| | |
|---|---|
| Carnauba wax | 100 parts |
| Nonionic emulsifier (EMULGEN 950 from Kao Corporation) | 20 part |
| Ion-exchange water | 380 parts |

The mixture was heated to 70° C. to melt the carnauba wax, followed by cooling. Thus, a wax emulsion was prepared.

Next, the following components were mixed using a HOMOMIXER mixer from Tokushu Kika Kogyo Co., Ltd.

| | |
|---|---|
| Carbon black (PRINTEX 35 from Degussa A.G.) | 20 parts |
| Metal complex of salicylic acid (E-84 from Orient Chemical Industries Co., Ltd.) | 1 part |
| Anionic emulsifier (NEOGEN R from Dai-ichi Kogyo Seiyaku Co., Ltd.) | 0.5 parts |
| Wax emulsion prepared above (The content of the wax in the toner is 3% by weight.) | 15 parts |
| Ion-exchange water | 310 parts |

After the mixture was agitated for 2 hours at 25° C., 188 parts of the resin emulsion prepared above was added thereto. After the mixture was agitated for 2 hours, the mixture was heated to 60° C. In addition, ammonia was added thereto to control the pH of the mixture at 7.0. The mixture was then heated to 90° C., and the temperature was maintained for 2 hours. Thus, a dispersion slurry was prepared.

One hundred (100) parts of the thus prepared dispersion slurry was filtered under a reduced pressure.

The thus prepared wet cake was mixed with 100 parts of ion-exchange water and the mixture was agitated for 10 minutes with a TK HOMOMIXER mixer, whose rotor was rotated at a revolution of 12,000 rpm, followed by filtering. Thus, a wet cake (a') was prepared.

The thus prepared wet cake (a') was mixed with a 10% by weight of hydrochloric acid to control the pH thereof at 2.8, and the mixture was agitated for 10 minutes using the TK HOMOMIXER mixer, whose rotor was rotated at a revolution of 12,000 rpm, followed by filtering. Thus, a wet cake (b') was prepared. Further, the wet cake (b') was mixed with 300 parts of ion-exchange water and the mixture was agitated for 10 minutes with a TK HOMOMIXER mixer, whose rotor was rotated at a revolution of 12,000 rpm, followed by filtering. This washing operation was performed twice to prepare a final wet cake.

The thus prepared final wet cake was dried for 48 hours at 45° C. using a circulating air drier, followed by sieving with a screen having openings of 75 μm.

Thus, comparative black mother toner particles were prepared.

One hundred (100) parts of the comparative mother toner particles were mixed with 1 part of a silica A, which has a BET specific surface area of 21 m/g, a moisture content of 0.4% by weight, and a bulk density of 140 g/l, 1.5 parts of a silica B, which has a BET specific surface area of 140 m/g, a moisture content of 0.4% by weight, and a bulk density of 140 g/l, and 0.5 parts of a hydrophobic titanium oxide using a HENSCHEL MIXER mixer (from Mitsui Mining Co., Ltd.).

Thus, a black toner of Comparative Example 1 was prepared.

Comparative Example 2

The procedure for preparation of the toner in Example 1 was repeated except that the particulate resin B was not added to the aqueous medium.

Thus, a black toner of Comparative Example 2 was prepared.

Comparative Example 3

The procedure for preparation of the toner in Example 1 was repeated except that the particulate resin A was not included in the aqueous medium.

Thus, a black toner of Comparative Example 3 was prepared.

Each of the above prepared toners of Examples 1-5 and Comparative Examples 1-3 was evaluated by the following methods.

1. First Inter-Particle Force (Fp(A)) and Second Inter-Particle Force (Fp(B)) of Toner The method for measuring the first and second inter-particle forces Fp(A) and Fp(B) is mentioned above.

2. Number Average Particle Diameter (Dn), Volume Average Particle Diameter (Dv), and Ratio (Dn/Dv) of Toner The number average particle diameter and volume average particle diameter of a toner are measured using an instrument MULTISIZER III from Beckman Coulter Inc., and analysis software BECKMAN COULTER MULTISIZER III Version 3.51.

Specifically, the procedure is as follows:

1) 0.5 ml of a 10% aqueous solution of an alkylbenzenesulfonic acid salt (NEOGEN SC-A from Dai-ich Kogyo Seiyaku Co., Ltd.), is mixed with 0.5 mg of a sample (toner), using a micro spatula;

2) 80 parts of ion-exchange water is added to the mixture, and the mixture was dispersed for 1 minute using a supersonic dispersing machine W-113MK-II from Honda Electronics Co., Ltd.; and 3) The dispersion is added to an electrolyte ISOTON-III from Beckman Coulter Inc., in the instrument (MULTISIZER III) so that the concentration of the sample indicated by the instrument falls in a range of 8±2% to measure the number average particle diameter Dn and volume average particle diameter Dv using an aperture of 100 μm.

The ratio Dn/Dv is also determined.

3. Average circularity (AC) of toner and content of particles having particle diameters of not greater than 2 μm ($C_{<2\mu m}$) in the toner The average circularity of the toner and the content of particles having particle diameters of not greater than 2 μm in the toner are determined by the following method using a flow-type particle image analyzer FPIA-2100 from Sysmex Corp., and analysis software FPIA-2100 DATA PROCESSING PROGRAM FOR FPIA Version 00-10 from Sysmex Corp. The procedure is as follows.

1) 0.1 to 0.5 ml of a 10% by weight solution of a surfactant (alkylbenzene sulfonate, NEOGEN SC-A from Dai-ichi Kogyo Seiyaku Co., Ltd.) and 0.1 to 0.5 g of a sample (i.e., toner) are fed into 100 to 150 ml of ion-exchange water;

2) the mixture is dispersed for 1 to 3 minutes using a supersonic dispersing machine (W-113MK-II from Honda Electronics Co., Ltd.) to prepare a toner dispersion; and 5) the average circularity and the content of particles having particle diameters of not greater than 2 μm are determined by the measuring instrument mentioned above, wherein the concentration of the dispersion is controlled such that the dispersion includes particles of 5,000 to 15,000 per 1 micro-liter.

4. Image Qualities of Toner 4-1 Black Spot

After 10,000 copies of an original image having an image area proportion of 5% are produced using an image forming apparatus IMAGIO MP9001 from Ricoh Co., Ltd., 100 copies of a solid image are produced. In this regard, the toner is used as a one component developer. The number of black spots present in the copied solid images is counted. The black spot property is graded as follows:

Excellent: The number of black spots is less than 10.

Good: The number of black spots is not less than 10 and less than 100.

Usable: The number of black spots is not less than 100 and less than 1,000.

Unusable: The number of black spots is not less than 1,000.

4-2 Toner Scattering

Similarly to the image forming operation mentioned above in paragraph-4-1, after 100,000 copies of an original image having an image area proportion of 20% are produced, a solid image with a size of 10 mm×10 mm is produced on a receiving paper TYPE 6000 from Ricoh Co., Ltd. The solid image is observed to determine whether scattered toner particles are present on the receiving paper while compared with three steps of images in toner scattering to grade the toner scattering property of the toner as follows.

Good: Toner scattering property is on a good level.

Usable: Toner scattering property is on a usable level.

Unusable: Toner scattering property is on an unusable level.

The evaluation results are shown in Tables 1 and 2.

TABLE 1

| | Fp (A) (N) | Fp (B) - Fp (A) (N) | AC | Dv (μm) | Dv/Dn | $C_{<2\mu m}$ (% by number) |
|---|---|---|---|---|---|---|
| Ex. 1 | $5.7 \times 10^{-8}$ | $9.6 \times 10^{-9}$ | 0.967 | 5.3 | 1.12 | 4 |
| Ex. 2 | $8.4 \times 10^{-9}$ | $1.9 \times 10^{-9}$ | 0.969 | 5.2 | 1.13 | 2 |
| Ex. 3 | $2.3 \times 10^{-9}$ | $2.2 \times 10^{-8}$ | 0.968 | 5.4 | 1.12 | 4 |
| Ex. 4 | $6.8 \times 10^{-7}$ | $2.8 \times 10^{-9}$ | 0.962 | 5.2 | 1.12 | 3 |
| Ex. 5 | $9.1 \times 10^{-7}$ | $6.1 \times 10^{-8}$ | 0.967 | 5.2 | 1.11 | 2 |
| Comp. Ex. 1 | $1.1 \times 10^{-10}$ | $3.4 \times 10^{-9}$ | 0.965 | 5.5 | 1.13 | 6 |
| Comp. Ex. 2 | $3.4 \times 10^{-6}$ | $2.1 \times 10^{-7}$ | 0.972 | 5.3 | 1.11 | 2 |
| Comp. Ex. 3 | $6.5 \times 10^{-7}$ | $4.5 \times 10^{-7}$ | 0.954 | 5.1 | 1.21 | 14 |

TABLE 2

| | Black spot | Toner scattering |
|---|---|---|
| Example 1 | Excellent | Good |
| Example 2 | Good | Usable |
| Example 3 | Excellent | Usable |
| Example 4 | Good | Good |
| Example 5 | Usable | Good |
| Comparative Example 1 | Excellent | Unusable |
| Comparative Example 2 | Unusable | Good |
| Comparative Example 3 | Unusable | Good |

It is clear from Tables 1 and 2 that the toner of the present invention is superior with respect to the black spot property and toner scattering property. In contrast, the toner of Comparative Example 1 has poor toner scattering property because the first inter-particle force Fp(A) thereof is small. In addition, the toner of Comparative Example 2 has poor black spot property (i.e., a solid image has a large number of black spots) because the difference (Fp(B)−Fp(A)) is large. Since the toner of Comparative Example 2 does not include a particulate resin B, the toner has a large Fp(A), resulting in deterioration of feeding property. Further, since the toner of Comparative Example 3 does not include a particulate resin A, embedding of the particulate resin B cannot be prevented and the release agent included therein tends to exude therefrom at 50° C. Therefore, the difference (Fp(B)−Fp(A)) of the toner increases, resulting in deterioration of the black spot property.

This document claims priority and contains subject matter related to Japanese Patent Application No. 2009-157230, filed on Jul. 1, 2009, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a binder resin;

a colorant; and a release agent, wherein the toner satisfies the following relationships (1) and (2):

$$1.0\times10^{-9}(N)\leqq Fp(A)<1.0\times10^{-6}(N) \quad (1)$$

$$0(N)<Fp(B)-Fp(A)\leqq1.0\times10^{-7}(N) \quad (2)$$

wherein

Fp(A) represents a first inter-particle force of the toner, which is measured under an environmental condition of 23° C. and 60% RH after the toner is pressed for 1 minute at 25° C. under a compression stress of 15 kg/cm$^2$, and Fp(B) represents a second inter-particle force of the toner, which is measured under the environmental condition of 23° C. and 60% RH after the toner is pressed for 1 minute at 50° C. under a compression stress of 15 kg/cm$^2$.

2. The toner according to claim 1, further comprising:

a modified layered inorganic material in which at least part of metal cations is replaced with an organic cation.

3. The toner according to claim 1, further comprising:

a particulate inorganic material having a BET specific surface area of from 50 m$^2$/g to 400 m$^2$/g.

4. The toner according to claim 1, wherein the toner has an average circularity of from 0.94 to 0.99.

5. The toner according to claim 1, wherein the toner has a volume average particle diameter (Dv) of from 3 μm to 8 μm, and a ratio (Dv/Dn) of the volume average particle diameter (Dv) of the toner to a number average particle diameter (Dn) of the toner is from 1.00 to 1.30.

6. The toner according to claim 1, wherein the toner includes particles having a particle diameter of not greater than 2 μm in an amount of from 1% by number to 10% by number.

7. A method for preparing the toner according to claim 1, comprising:

dissolving or dispersing toner constituents including at least a polyester resin serving as the binder resin, the colorant and the release agent in an organic solvent to prepare a first liquid;

mixing an anionic surfactant, and a particulate anionic resin, which has a volume average particle diameter of from 5 nm to 50 nm, with an aqueous medium to prepare an aqueous liquid;

emulsifying the first liquid in the aqueous liquid to prepare a second liquid;

adding a particulate resin having a volume average particle diameter of from 50 nm to 500 nm to the aqueous liquid or the second liquid; and then removing the organic solvent from the second liquid.

8. The method according to claim 7, wherein the polyester resin includes a polyester prepolymer having a functional group capable of reacting with an active hydrogen atom, and wherein the method further comprising:

adding a compound having an active hydrogen atom to the first liquid, the aqueous liquid or the second liquid; and reacting the polyester prepolymer with the compound having a hydrogen atom in the second liquid.

9. The method according to claim 7, wherein the toner constituents further include:

a modified layered inorganic material in which at least part of metal cations is replaced with an organic cation, and wherein the first liquid has a Casson yield value of from 1 Pa to 100 Pa at 25° C.

10. The method according to claim 9, wherein the modified layered inorganic material is included in the first liquid in an amount of from 0.05% by weight to 10% by weight based on solid components included in the first liquid.

11. An image forming method comprising:

forming an electrostatic latent image on an image bearing member;

developing the electrostatic latent image with a developer including the toner according to claim 1 to prepare a toner image on the image bearing member;

transferring the toner image onto a receiving material; and fixing the toner image to the receiving material.

12. The toner according to claim 1, wherein 0 (N)≦Fp(B)−Fp(A)≦1.0×10$^{-8}$ (N).

13. The toner according to claim 1, wherein Fp(B)−Fp(A) is 0 (N).

14. The toner according to claim 1, wherein the binder resin comprises a polyester resin.

15. The toner according to claim 1, wherein the binder resin comprises a urea-modified polyester resin and an unmodified polyester resin.

16. The toner according to claim 1, wherein the binder resin has a glass transition temperature of from 30 to 70° C.

17. The toner according to claim 1, which further comprises a release agent.

* * * * *